US009685293B1

(12) United States Patent
Watford

(10) Patent No.: US 9,685,293 B1
(45) Date of Patent: Jun. 20, 2017

(54) APPARATUS AND METHOD OF BLOCKING AND UNBLOCKING A BREAKER HANDLE OF A CIRCUIT BREAKER

(71) Applicant: Siemens Industry, Inc., Alpharetta, GA (US)

(72) Inventor: Russell Thomas Watford, Lawrenceville, GA (US)

(73) Assignee: SIEMENS INDUSTRY, INC., Alpharetta, GA (US)

( * ) Notice: Subject to any disclaimer, the term of this patent is extended or adjusted under 35 U.S.C. 154(b) by 0 days.

(21) Appl. No.: 15/131,717

(22) Filed: Apr. 18, 2016

(51) Int. Cl.
*H01H 9/28* (2006.01)
*H01H 71/10* (2006.01)

(52) U.S. Cl.
CPC ..... *H01H 71/1054* (2013.01)

(58) Field of Classification Search
CPC H01H 3/20; H01H 9/286; H01H 9/20; H01H 71/12
USPC ..... 200/43.16, 43.14, 43.15, 43.01; 335/6
See application file for complete search history.

(56) References Cited

U.S. PATENT DOCUMENTS

| | | | | |
|---|---|---|---|---|
| 7,864,003 | B2 * | 1/2011 | Yang | H01H 71/46 324/424 |
| 8,134,428 | B2 * | 3/2012 | Watford | H01H 71/02 335/106 |
| 8,742,270 | B2 * | 6/2014 | Hatano | H01H 71/10 200/43.16 |
| 9,064,666 | B2 * | 6/2015 | Wan | H01H 71/10 |

* cited by examiner

*Primary Examiner* — Vanessa Girardi

(57) ABSTRACT

An apparatus and a method are provided to block and unblock a breaker handle of a circuit breaker having main contacts. The apparatus comprises a locking mechanism including a locking handle shaft and a locking latch. The locking handle shaft is configured to latch the locking mechanism for keeping the breaker handle in a mid-position in which the main contacts stay open. The locking handle shaft has a latching surface configured to be removed from its position in order to rotate the breaker handle to a fully ON position in which the main contacts fully close. The locking latch is configured to prevent rotation of the locking handle shaft. The locking latch is configured to engage and disengage with the locking handle shaft in order to rotate the breaker handle from a reset position to the mid-position in which the locking mechanism locks the breaker handle rotation thus preventing the main contacts from closing. The breaker handle is stopped at the mid-position by the locking mechanism until a self-test is passed.

20 Claims, 16 Drawing Sheets

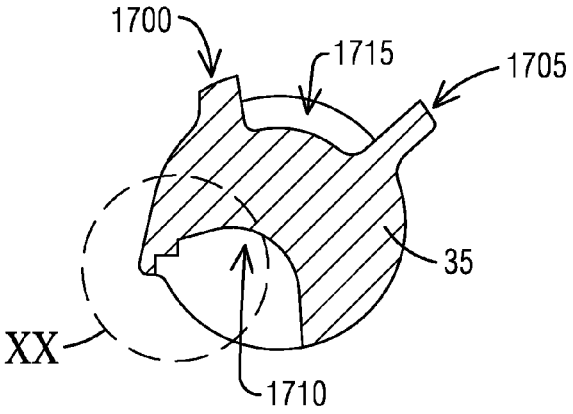
FIG. 17
FIG. 18
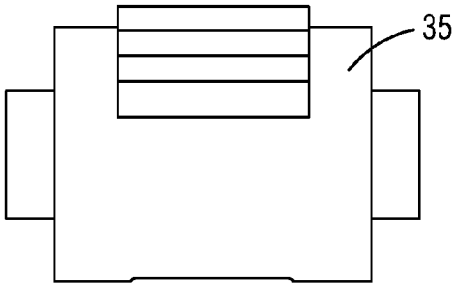
FIG. 19
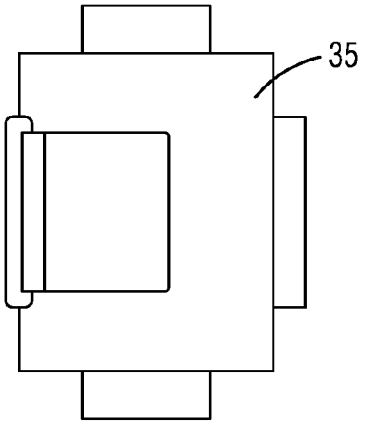
FIG. 20
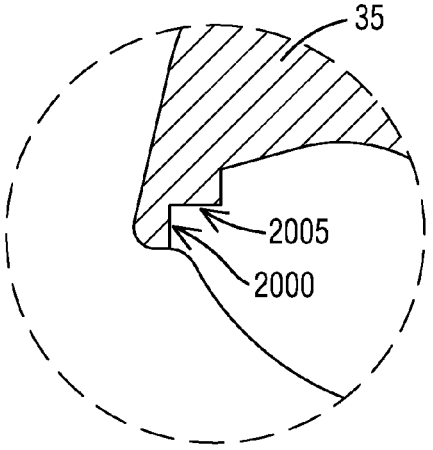

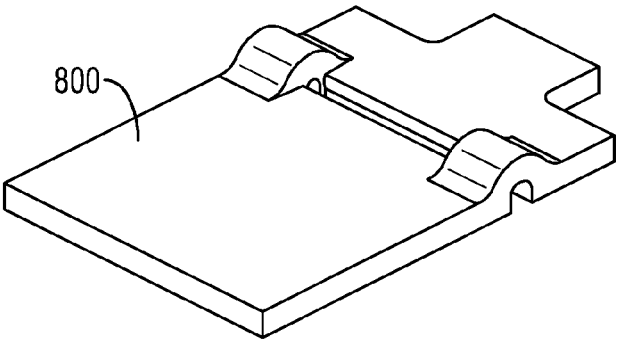
FIG. 21
FIG. 22
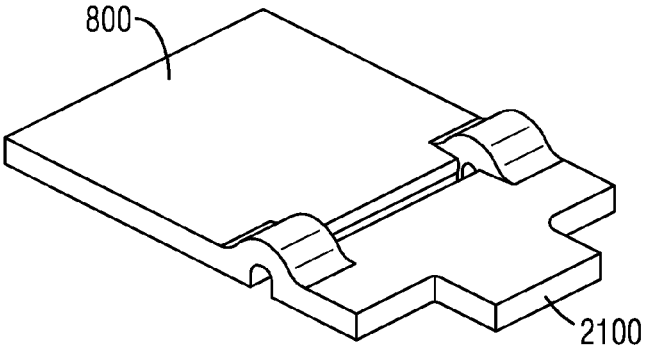
FIG. 23
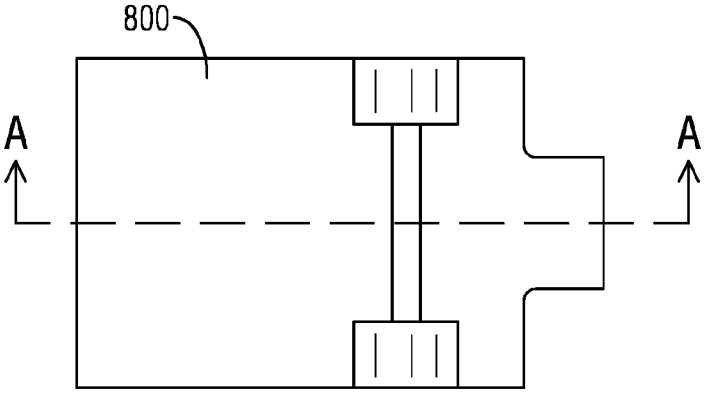
FIG. 25
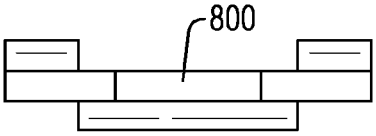
FIG. 24
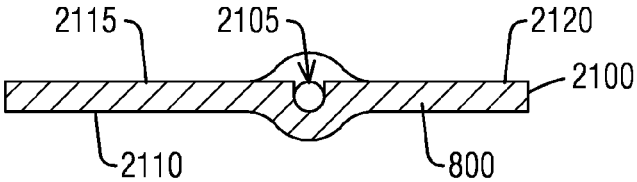

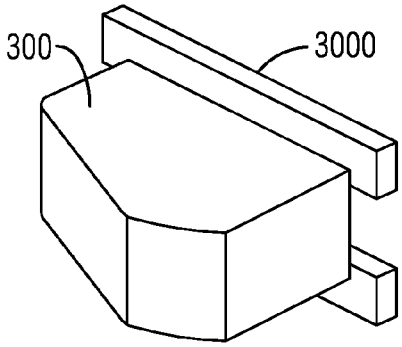
FIG. 30
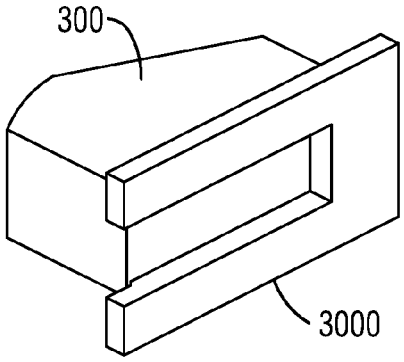
FIG. 31
FIG. 32
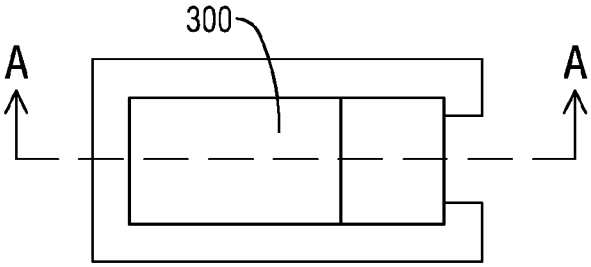
FIG. 33
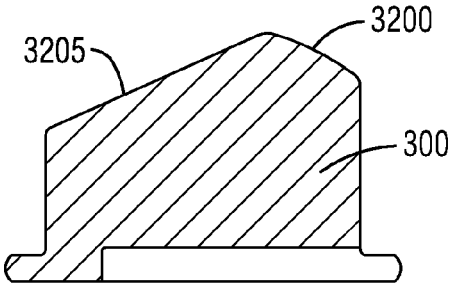
FIG. 34
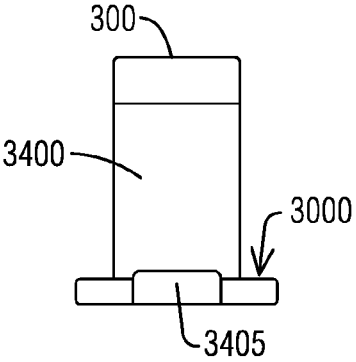

APPARATUS AND METHOD OF BLOCKING AND UNBLOCKING A BREAKER HANDLE OF A CIRCUIT BREAKER

BACKGROUND

1. Field

Aspects of the present invention generally relate to a breaker handle block and unblock mechanism of a circuit breaker and more specifically relates to a locking mechanism for blocking and unblocking a breaker handle of a multi-pole electronic circuit breaker.

2. Description of the Related Art

Electrical circuit branches of single-phase AC power systems typically use electrical cables that include a line conductor and a neutral conductor coupled between a source and a load, with the neutral conductor grounded at the source. Ground fault circuit interrupt ("GFCI") devices are installed in such circuit branches to interrupt power upon detection of ground current faults from the line conductor to ground at the load, as well as grounded neutral faults (e.g., low impedance connection faults) between the neutral conductor and ground at the load. Electrical arcs can develop temperatures well above the ignition level of most common flammable materials and, therefore, pose a significant fire hazard. Two types of dangerous arcing that are likely to occur in the home are momentary, high-energy arcs caused by high-current faults and persistent, low-current "contact" arcing. As such, the maximum current in the arc is limited to the load current and, therefore, may be substantially below the over-current or "trip" rating of an associated circuit breaker. Arc fault circuit interrupt ("AFCI") devices are used in circuit breakers which are installed to prevent dangerous conditions due to high-energy arcs and contact arcing.

A two-pole circuit breaker is constructed by pairing two single pole circuit interrupters into one construction. The two-pole circuit breaker could be a traditional circuit interrupter or an electronic circuit interrupter that detects ground faults and/or arc faults as well as over current conditions of equipment electrically coupled as a load to the two-pole circuit breaker.

Two-pole residential circuit breakers do not provide a means to block a breaker handle from going to a fully ON position in which the main contacts of the circuit breaker fully close. Thus preventing the main contacts to close. This is important in the event of two conditions. One condition is if the arc or ground fault circuitry is no longer able to detect a fault condition. The second condition is if a fault condition is present when the circuit breaker is turned to the fully ON position. In both cases, the breaker handles today can be rotated to the fully ON position and the main contacts close.

Therefore, there is a need for improvements to preventing the main contacts of a circuit breaker to close for preventing a dangerous situation involving a fault condition.

SUMMARY

Briefly described, aspects of the present invention relate to multi-pole circuit breakers such as residential two-pole electronic circuit breakers that provide a locking mechanism to block and unblock a beaker handle of a circuit breaker. In particular, embodiments of the present invention remedy a dangerous condition involving a fault condition by electronically making a self-test. Thus, the two-pole circuit breaker prevents a dangerous situation where either a fault condition is not detected or if a fault condition is present the circuit breaker is stopped from turning to the fully ON position. One of ordinary skill in the art appreciates that such a safety system can be configured to be installed in different environments where such protection is needed, for example, in GFCI and AFCI circuit breakers.

In accordance with one illustrative embodiment of the present invention, an apparatus is provided to block and unblock a breaker handle of a circuit breaker having main contacts. The apparatus comprises a locking mechanism including a locking handle shaft and a locking latch. The locking handle shaft is configured to latch the locking mechanism for keeping the breaker handle in a mid-position in which the main contacts stay open. The locking handle shaft has a latching surface configured to be removed from its position in order to rotate the breaker handle to a fully ON position in which the main contacts fully close. The locking latch is configured to prevent rotation of the locking handle shaft. The locking latch is configured to engage and disengage with the locking handle shaft in order to rotate the breaker handle from a reset position to the mid-position in which the locking mechanism locks the breaker handle rotation thus preventing the main contacts from closing. The breaker handle is stopped at the mid-position by the locking mechanism until a self-test is passed.

In accordance with another illustrative embodiment of the present invention, a circuit breaker having main contacts is provided. The circuit breaker comprises a breaker handle and first, second, and third modules. The second module is disposed in between the first and third modules. The second module includes a locking mechanism to block and unblock the breaker handle of the circuit breaker. The locking mechanism includes a locking handle shaft and a locking latch. The locking handle shaft is configured to latch the locking mechanism for keeping the breaker handle in a mid-position in which the main contacts stay open. The locking handle shaft has a latching surface configured to be removed from its position in order to rotate the breaker handle to a fully ON position in which the main contacts fully close. The locking latch is configured to prevent rotation of the locking handle shaft. The locking latch is configured to engage and disengage with the locking handle shaft in order to rotate the breaker handle from a reset position to the mid-position in which the locking mechanism locks the breaker handle rotation thus preventing the main contacts from closing. The breaker handle is stopped at the mid-position by the locking mechanism until a self-test is passed.

In accordance with yet another illustrative embodiment of the present invention, a method of blocking and unblocking a breaker handle of a circuit breaker having main contacts is provided. The method comprises latching using a locking handle shaft a locking mechanism that blocks and unblocks the breaker handle for keeping the breaker handle in a mid-position in which the main contacts stay open, the locking handle shaft having a latching surface configured to be removed from its position in order to rotate the breaker handle to a fully ON position in which the main contacts fully close, preventing using a locking latch rotation of the locking handle shaft, wherein the locking latch is configured to engage and disengage with the locking handle shaft in order to rotate the breaker handle from a reset position to the mid-position in which the locking mechanism locks the breaker handle rotation thus preventing the main contacts from closing and stopping the breaker handle at the mid-position by the locking mechanism until a self-test is passed.

BRIEF DESCRIPTION OF THE DRAWINGS

FIG. 17 illustrates a cross-sectional view of the locking handle shaft of a two-pole circuit breaker in FIG. 15 at an A-A axis in accordance with one illustrative embodiment of the present invention.

FIG. 18 illustrates another side view of a locking handle shaft of a two-pole circuit breaker in accordance with one illustrative embodiment of the present invention.

FIG. 19 illustrates another top view of a locking handle shaft of a two-pole circuit breaker in accordance with one illustrative embodiment of the present invention.

FIG. 20 illustrates a cutout cross-sectional view of the locking handle shaft of a two-pole circuit breaker in FIG. 17 in accordance with one illustrative embodiment of the present invention.

FIGS. 21-22 illustrate an isometric view of a locking latch of a two-pole circuit breaker in accordance with one illustrative embodiment of the present invention.

FIG. 23 illustrates a top view of a locking latch of a two-pole circuit breaker in accordance with one illustrative embodiment of the present invention.

FIG. 24 illustrates a cross-sectional view of the locking latch of a two-pole circuit breaker in FIG. 23 at an A-A axis in accordance with one illustrative embodiment of the present invention.

FIG. 25 illustrates a side view of a locking latch of a two-pole circuit breaker in accordance with one illustrative embodiment of the present invention.

FIGS. 30-31 illustrate an isometric view of a handle switch of a two-pole circuit breaker in accordance with one illustrative embodiment of the present invention.

FIG. 32 illustrates a top view of a handle switch of a two-pole circuit breaker in accordance with one illustrative embodiment of the present invention.

FIG. 33 illustrates a cross-sectional view of the handle switch of a two-pole circuit breaker in FIG. 32 at an A-A axis in accordance with one illustrative embodiment of the present invention.

FIG. 34 illustrates a side view of a handle switch of a two-pole circuit breaker in accordance with one illustrative embodiment of the present invention.

DETAILED DESCRIPTION

To facilitate an understanding of embodiments, principles, and features of the present invention, they are explained hereinafter with reference to implementation in illustrative embodiments. In particular, they are described in the context of a locking mechanism for blocking and unblocking a breaker handle of a circuit breaker in combination with electronic monitoring via a self-test in that a self-test circuit stops the breaker handle at a mid-position prior to going to a fully ON position in which the main contacts close until the self-test is passed. Embodiments of the present invention, however, are not limited to use in the described devices or methods.

The components and materials described hereinafter as making up the various embodiments are intended to be illustrative and not restrictive. Many suitable components and materials that would perform the same or a similar function as the materials described herein are intended to be embraced within the scope of embodiments of the present invention.

A condition monitoring and response system is provided for blocking and unblocking a breaker handle of a circuit breaker such as a multi-pole GFCI or AFCI circuit breaker or Combination Type Arc Fault Circuit Interrupters (CAFCI). A locking mechanism comprises a locking handle shaft to latch the locking mechanism for keeping the breaker handle in a mid-position in which the main contacts stay open. The locking mechanism further comprises a locking latch configured to prevent rotation of the locking handle shaft. The locking mechanism locks the breaker handle rotation thus preventing the main contacts from closing. In this way, the two-pole circuit breaker prevents an unsafe situation involving a fault condition by preventing the main contacts of a circuit breaker to close. Accordingly, a condition that could be hazardous to equipment electrically coupled as a load to the two-pole circuit breaker may be avoided. A user who is working with equipment electrically coupled as a load to the two-pole circuit breaker would be safe.

Accordingly, a safety feature is provided for circuit breakers such as a multi-pole GFCI or AFCI or CAFCI circuit breaker. In one embodiment, this solution provides protection to equipment electrically coupled as a load to the circuit breaker and ensures safety of user who is working with equipment electrically coupled as a load to the circuit breaker.

Figure 1:
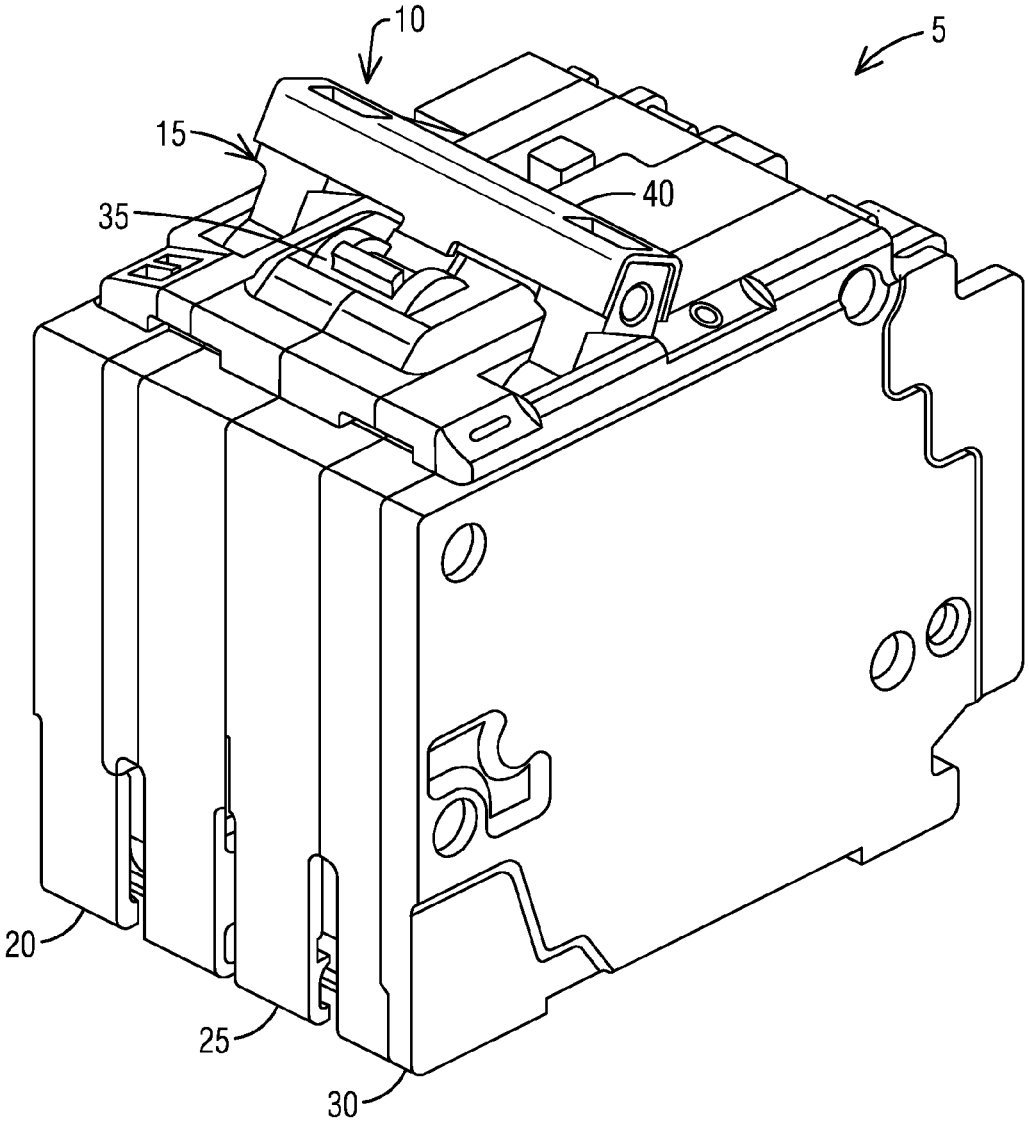
FIG. 1 illustrates an isometric view of a two-pole circuit breaker including a locking mechanism for blocking and unblocking a beaker handle of the two-pole circuit breaker in accordance with one illustrative embodiment of the present invention.

FIG. 1 illustrates an isometric view of a two-pole circuit breaker 5 including a locking mechanism 10 for blocking and unblocking a beaker handle 15 of the two-pole circuit breaker 5 in accordance with one illustrative embodiment of the present invention. The locking mechanism 10 locks the breaker handle 15 rotation thus preventing main contacts (not shown) from closing by blocking and unblocking the breaker handle 15 in a mid-position prior to a fully ON position. This is done in combination of electronically monitoring via a self-test in that the breaker handle 15 stopped at the mid-position prior to the fully ON position in which the main contacts close until the self-test is passed. In this way, the two-pole circuit breaker 5 prevents an unsafe situation involving a fault condition by preventing the main contacts of the two-pole circuit breaker 5 to close. Accordingly, the two-pole circuit breaker 5 prevents a dangerous situation where either a fault condition is not detected or if a fault condition is present the breaker handle 15 of the two-pole circuit breaker 5 is stopped from turning all the way to the fully ON position.

As used herein, the "two-pole circuit breaker" refers to a multi-pole circuit breaker, as described herein that corresponds to an automatically operated electrical switch designed to protect an electrical circuit from damage caused by overload or short circuit. Its basic function is to detect a fault condition and interrupt current flow. The "multi-pole circuit breaker," in addition to the exemplary hardware description above, refers to a device that is configured to reset (either manually or automatically) to resume normal operation. The "multi-pole circuit breaker," may be used to protect an individual household appliance up to a large switchgear designed to protect high voltage circuits feeding an entire city, and operated by a controller. It should be appreciated that several other components may be included in the "multi-pole circuit breaker." However, the function and use of such equipment for a circuit breaker application are well known in the art and are not discussed further. The "multi-pole circuit breaker," may be capable of operating based on its features such as voltage class, construction type, interrupting type, and structural features.

Suitable dual function circuit breakers model no. QFGA2 and MP-GAT2 those combine GFCI and AFCI functionality, protecting against both Arc Faults and Ground Faults are available from Siemens Industry Inc. located at 5400 Triangle Parkway, Norcross, Ga. 30092. Likewise, suitable Ground Fault Circuit Interrupters (GFCI) to protect against severe electrical shock or electrocution from ground faults are available. Arc Fault Circuit Interrupters (AFCI) and Combination Type Arc Fault Circuit Interrupters (CAFCI) are also available. A person skilled in the pertinent art would appreciate that other suitable circuit breakers may be readily deployed based on a specific implementation without departing from the scope of the present invention.

Consistent with one embodiment, the two-pole circuit breaker 5 comprises an assembly of a module one 20, a module two 25 and a module three 30 in that the module two 25 is sandwiched between the module one 20 and the module three 30. In one embodiment, the two-pole circuit breaker 5 consists of 3 modules—on the left the module one 20, in center the module two 25, and on the right the module three 30. Modules one 20 and module three 30 include mechanisms that will close a main pair of contacts when the breaker handle 15 is rotated to the fully ON position. Each module 20, 30 includes a moveable and stationary contact, moveable arm, stationary terminal, cradle, a breaker handle, springs, armature, a base, and a cover. These are typical mechanical components of a residential circuit breaker.

The module two 25 includes a means to block the breaker handle 15 rotation, i.e. the locking mechanism 10, when rotated from a reset position to the fully ON position. The module two 25 includes a locking handle shaft 35 that interfaces with the breaker handle 15 through a breaker handle tie bar 40. The locking handle shaft 35 to latch the locking mechanism 10 for keeping the breaker handle 15 in a mid-position in which the main contacts stay open. The locking handle shaft 35 has a latching surface configured to be removed from its position in order to rotate the breaker handle 15 to a fully ON position in which the main contacts fully close. The locking handle shaft 35 is configured to de-latch before the breaker handle 15 rotates counterclockwise to the fully ON position from an Over Center to ON (OC-ON) position (See FIG. 48) of the breaker handle 15 allowing the main contacts to fully close. The locking handle shaft 35 may be made of a thermoplastic Nylon 6/6 material such as BASF A3EG6 or a mineral filled Phenolic material, for example Durez 152.

The locking mechanism 10 includes an integrated return torsion spring for the locking latch. The locking mechanism further includes a driving-counterclockwise feature to rotate the locking handle shaft 35 counterclockwise and a return-clockwise feature to rotate the locking handle shaft 35 clockwise.

Although three modules 20, 25, 30 are shown in FIG. 1, the number of modules may be increased or reduced into a different number or an arrangement of modules that accomplishes the same means to selectively block the breaker handle 15 rotation.

The breaker handle tie bar 40 overlaps each portion of the breaker handle 15 in the module one 20 and the module three 30 and includes an extended tab feature to interface with the locking handle shaft 35. The locking mechanism 10 in the module two 25 is de-latched when the breaker handle 15 is in the fully ON position and reset as the breaker handle 15 is rotated to the reset position. The breaker handle tie bar 40 may be made of the metal or plastic and includes an extended tab that goes into a recessed area of the locking handle shaft 35.

Examples of the two-pole circuit breaker 5 include a multi-pole circuit breaker with ground fault circuit interrupt ("GFCI") devices and/or arc fault circuit interrupt ("AFCI") devices and/or CAFCI devices. GFCI devices are installed in circuit branches to interrupt power upon detection of ground current faults from the line conductor to ground at the load, as well as grounded neutral faults (e.g., low impedance connection faults) between the neutral conductor and ground at the load. AFCI devices are installed to prevent dangerous conditions due to high-energy arcs and contact arcing.

While particular embodiments are described in terms of the two-pole circuit breaker 5 as a circuit breaker, the techniques described herein are not limited to two-pole circuit interrupter but can be also used with other circuit breaker, such as different types of multi-pole circuit breakers.

Figure 2:
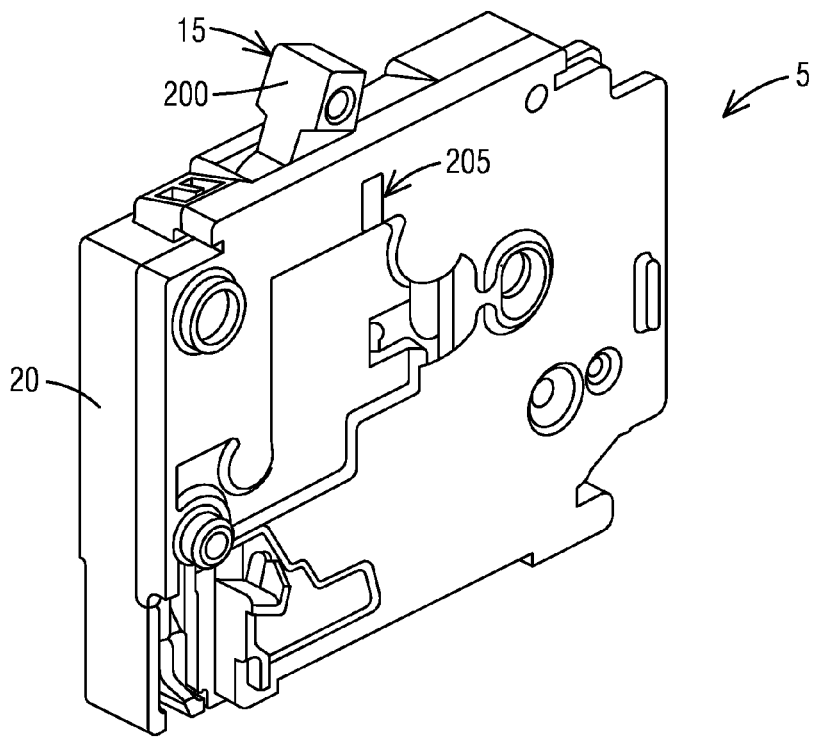
FIG. 2 illustrates an isometric view of a module one of the two-pole circuit breaker of FIG. 1 in accordance with one illustrative embodiment of the present invention.

Referring to FIG. 2, it illustrates an isometric view of the module one 20 of the two-pole circuit breaker 5 of FIG. 1 in accordance with one illustrative embodiment of the present invention. The module one 20 includes a portion 200 of the breaker handle 15 and an opening 205 for receiving a handle switch (not shown, see FIG. 3).

Figure 3:
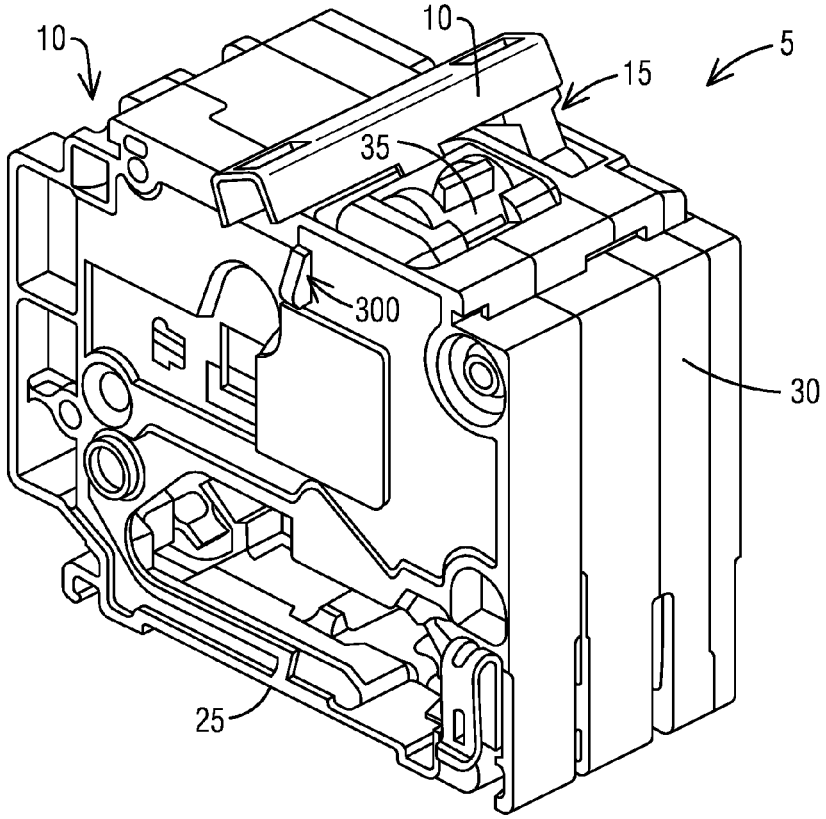
FIG. 3 illustrates an isometric view of a module two and a module three of the two-pole circuit breaker of FIG. 1 in accordance with one illustrative embodiment of the present invention.

Turning now to FIG. 3, it illustrates an isometric view of the module two 25 and the module three 30 of the two-pole circuit breaker 5 of FIG. 1 in accordance with one illustrative embodiment of the present invention. The locking mechanism 10 includes a handle switch 300 extending out of the module two 25 towards the adjacent opening 205 in the module one 20 as shown in FIG. 2. The handle switch 300 has an associated actuating lever (not shown) to activate the handle switch 300 during rotation of the breaker handle 15 and de-activate the handle switch 300 when the breaker handle 15 is rotated to the fully ON position. The breaker handle 15 has an extended tab to contact a surface of the handle switch 300 to close a self-test circuit for performing a self-test to verify whether an arc and/or ground fault detection circuitry of the two-pole circuit breaker 5 is working properly. The handle switch 300 may be made of a thermoplastic glass filled Nylon 6/6 material such as BASF A3EG6 and includes a wall around the lower portion of the handle switch 300 to retain it in the module two 25.

The locking handle shaft 35 prevents the breaker handle 15 to fully rotate to the fully ON position. The locking handle shaft 35 has a shaft that includes a feature that interfaces with the breaker handle tie bar 40 feature. The handle switch 300 is activated when the breaker handle 15 is rotated. The handle switch 300 includes a type of PCB switch and an actuating lever (not shown). The PCB switch is momentarily activated during the breaker handle's 15 rotation. The PCB switch is de-activated when the breaker handle 15 is rotated to the fully ON, trip, or reset positions.

Figure 4:
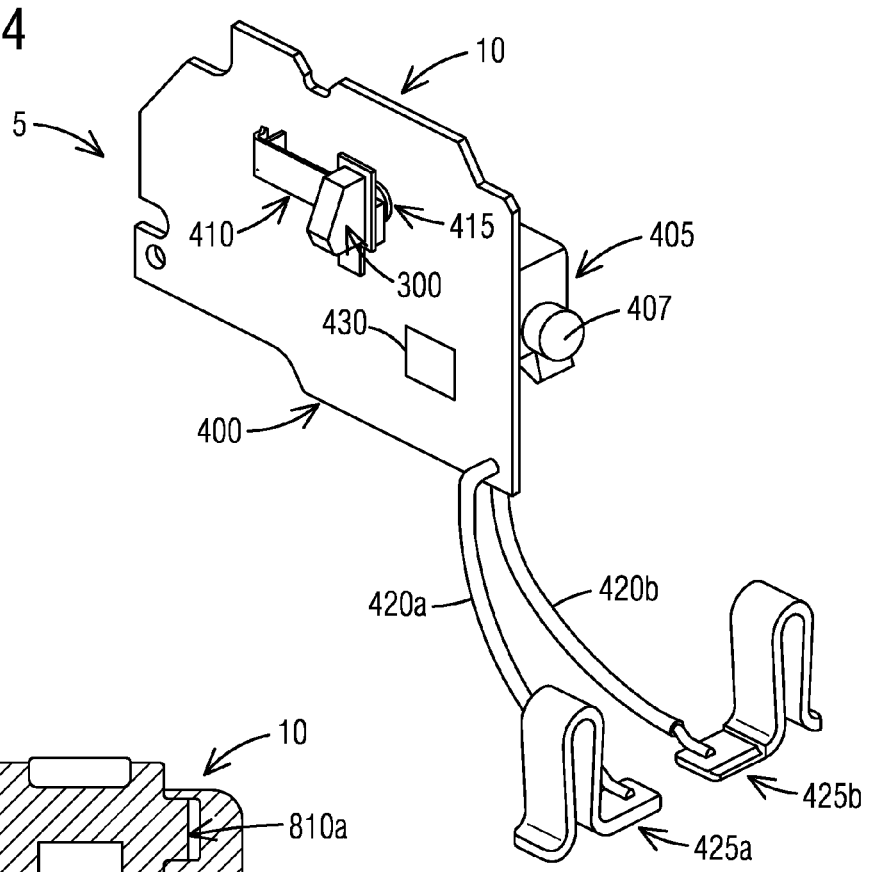
FIG. 4 illustrates an isometric view of a Printed Circuit Board (PCB) and a handle switch of a two-pole circuit breaker in accordance with one illustrative embodiment of the present invention.

FIG. 4 illustrates an isometric view of a Printed Circuit Board (PCB) 400 and the handle switch 300 of the two-pole circuit breaker 5 in accordance with one illustrative embodiment of the present invention. The locking mechanism 10 includes a solenoid 405 with a plunger 407, a PCB contact spring 410, PCB contacts 415 or switch, electrical connecting wires 420*a*, 420*b*, and line terminals 425*a*, 425*b* located within the module two 25.

The Printed Circuit Board (PCB) 400 includes the handle switch 300 to activate a self-test circuit 430. The self-test circuit 430 is configured to perform a self-test to verify whether an arc and/or ground fault detection circuitry of the two-pole circuit breaker 5 is working properly.

As shown, the PCB contact spring 410 may be made of a spring tempered copper alloy such as CDA 510. The PCB contact spring 410 is attached to the PCB 400 for mounting and providing an electrical connection. On the opposite end of the PCB contact spring 410, the PCB contacts 415 are welded to a bottom side. On the top side of the PCB contact spring 410, a handle switch feature wraps around a PCB spring tip. An additional contact is welded to the PCB 400. The PCB contacts 415 consist of, but not limited to, silver and tungsten combination and welded to the PCB 400 and the PCB contact spring 410 using a resistive type welding process.

In operation, a current is supplied to the PCB 400 with the electrical connecting wires 420*a*, 420*b* attached to the PCB 400 and to the line terminals 425*a*, 425*b*. The electrical connecting wires 420*a*, 420*b* for example may be, but not limited to, 16 AWG stranded wire with 105° C. insulation. The size of the wire depends on the handle rating of the two-pole circuit breaker 5.

As shown in FIG. 4, the solenoid 405 with the plunger 407 is used to disengage the locking handle shaft 35 and a locking latch (See FIG. 8) features. The solenoid 405 with the plunger 407 is configured to disengage the locking handle shaft 35 and the locking latch to de-latch the locking mechanism 10 by forcing the rotation of the locking latch to rotate clockwise once triggered for rotating the breaker handle 15 from the mid-position to an Over Center to ON (OC-ON) position. (See FIG. 48).

An alternative to a solenoid with a plunger, an electromagnet may be used to generate the same force needed to disengage the locking handle shaft 35 and the locking latch features. An electromagnet arrangement may be used to save space and/or reduce the number of moving parts.

Figure 5:
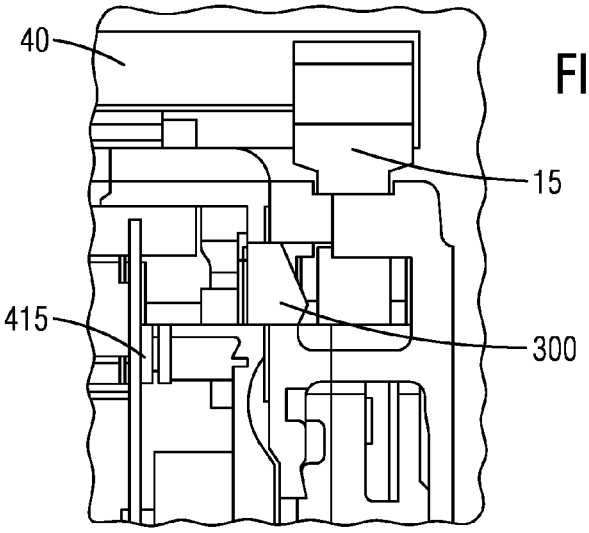
FIGS. 5-7 illustrate a side view of positions of a handle switch of a two-pole circuit breaker responsive to movement of a breaker handle feature in accordance with one illustrative embodiment of the present invention.
Figure 6:
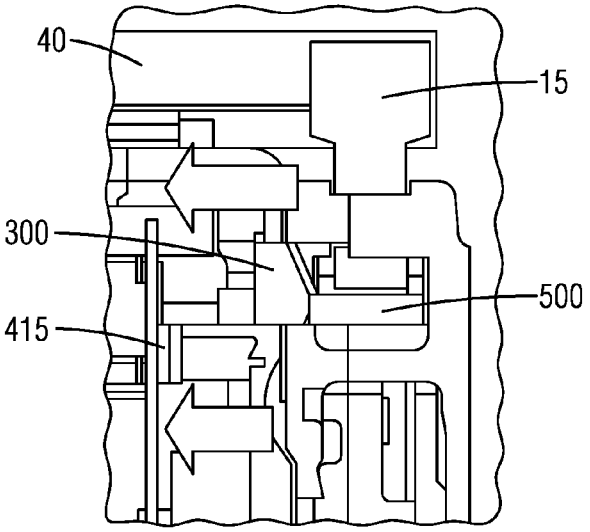
Figure 7:
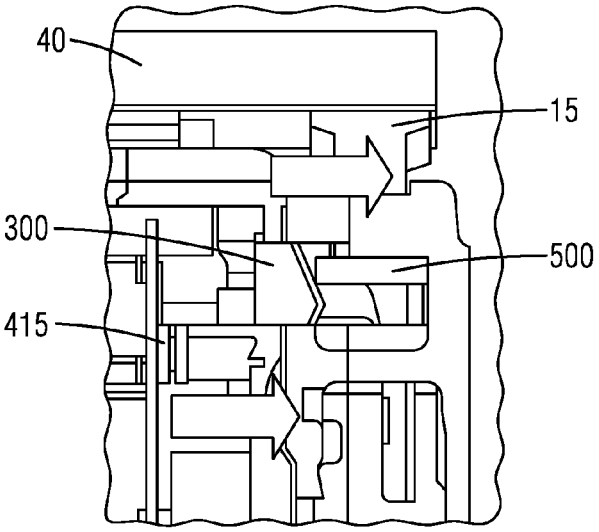

As shown in FIGS. 5-7, they illustrate a side view of positions of the handle switch 300 of the two-pole circuit breaker 5 responsive to movement of a breaker handle feature 500 of the breaker handle 15 in accordance with one illustrative embodiment of the present invention. FIGS. 5-7 show interaction between the breaker handle feature 500, the handle switch 300, and a PCB switch 505 with the PCB contacts 415 (See FIG. 4).

In FIG. 5, the breaker handle 15 is shown in the reset position. In this view, the breaker handle feature 500 does not contact the handle switch 300. As the breaker handle 15 is rotated counterclockwise from the reset position, the breaker handle feature 500 contacts a surface of the handle switch 300 near the down portion.

As seen in FIG. 6, the PCB contact spring 410 (See FIG. 4) deflects about 0.02-0.04 inch and allows the PCB contacts 415 (See FIG. 4) or a micro switch or a dome type switch to close. Once an electrical contact is made, the self-test circuit 430 (See FIG. 4) is closed and a self-test can be conducted to verify an arc and/or ground fault detection circuitry in the PCB 400 (See FIG. 4) is working properly.

A time required to conduct the self-test may be within 1 second after the self-test circuit 430 has been closed and would have minimum impact to the normal operation of turning the breaker handle 15 to the fully ON position. The self-test is active for a short duration and if passes, the solenoid 405 is triggered forcing the plunger 407 to strike a locking latch feature (See FIG. 11). The locking latch rotates clockwise and locking latch feature disengages with a locking shaft feature. Once de-latched, the locking shaft is free to rotate counterclockwise allowing the breaker handle 15 to rotate to the fully ON position.

In FIG. 7, when the breaker handle 15 is allowed to fully rotate to the fully ON position, the breaker handle feature 500 disengages with the handle switch 300. This allows the PCB contact spring 410 to return to its original state and opens the PCB contacts 415 or the micro/dome type switch when the two-pole circuit breaker 5 in the fully ON position.

Figure 8:
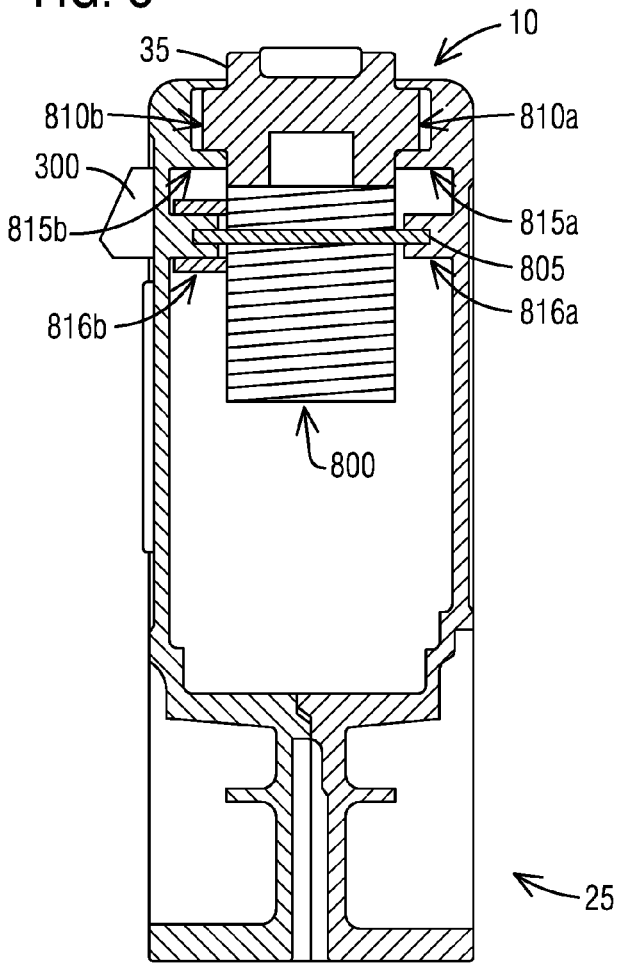
FIG. 8 illustrates a cross-sectional view of a module two with a locking handle shaft and a locking latch interfaces in accordance with one illustrative embodiment of the present invention.

With regard to FIG. 8, it illustrates a cross-sectional view of the module two 25 with the locking handle shaft 35 and a locking latch 800 interfaces in accordance with one illustrative embodiment of the present invention. The locking latch 800 is configured to prevent rotation of the locking handle shaft 35. The locking latch 800 is configured to engage and disengage with the locking handle shaft 35 in order to rotate the breaker handle 15 from a reset position to the mid-position in which the locking mechanism 10 locks the breaker handle 15 rotation thus preventing the main contacts from closing. The breaker handle 15 is stopped at the mid-position until a self-test is passed.

The locking handle shaft 35 includes a stop and the locking latch 800 defines a latching lever such that when the breaker handle 15 is moved to the reset position the latching lever is rotated counterclockwise and the latching lever stops against the stop of the locking handle shaft 35. The locking latch 800 is configured to rotate about a pivot. More specifically, the locking latch 800 is configured to rotate the breaker handle 15 to an Over Center to ON (OC-ON) position (See FIG. 48) in which the locking mechanism 10 unlocks the breaker handle 15 rotation thus moving the main contacts to close and then to rotate the breaker handle 15 to the fully ON position.

In particular, FIG. 8 shows the interface between the locking handle shaft 35 and a latch pivot pin 805. The locking latch 800 is held in position with the latch pivot pin 805. The locking handle shaft 35 includes shaft posts 810*a*, 810*b* which pivot in journals 815*a*, 815*b* of the module two 25. Each end of the latch pivot pin 805 is captured in the journals 815*a*, 815*b* of the module two 25.

Figure 9:
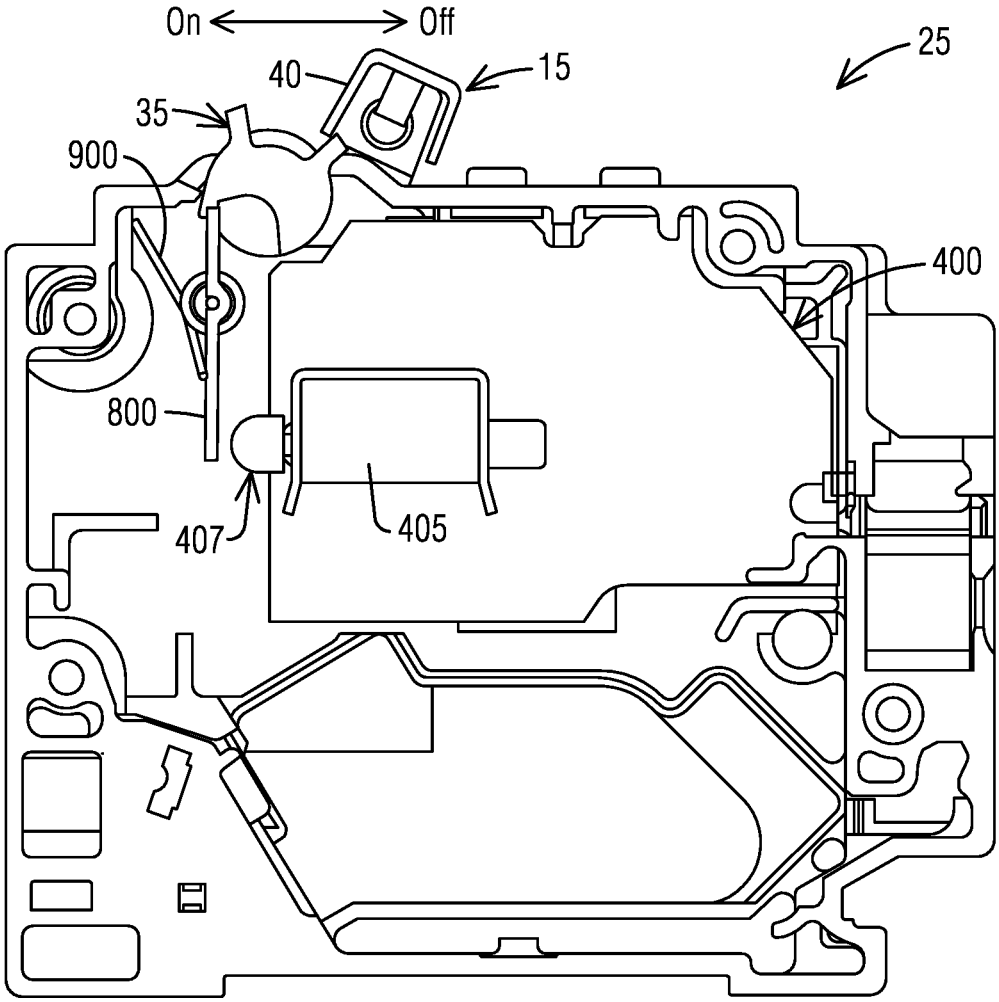
FIG. 9 illustrates a side view of a two-pole circuit breaker with the module two shown in an OFF position in accordance with one illustrative embodiment of the present invention.

With respect to FIG. 9, it illustrates a side view of the two-pole circuit breaker 5 with the module two 25 shown in an OFF position in accordance with one illustrative embodiment of the present invention. In particular, FIG. 9 shows the interface between the breaker handle 15, the breaker handle tie bar 40, the locking latch 800, the locking handle shaft 35, the solenoid 405, and a return torsion spring 900. As the breaker handle 15 is rotated counterclockwise, an extended tab of the breaker handle tie bar 40 begins to separate from a locking shaft feature.

Figure 10:
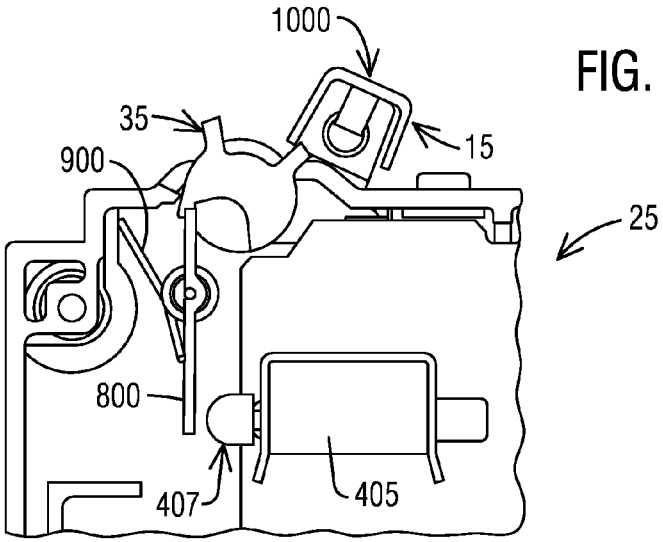
FIGS. 10-12 illustrate a side view of a breaker handle of a two-pole circuit breaker in a reset position, a mid-position, a fully ON position, respectively in accordance with one illustrative embodiment of the present invention.
Figure 11:
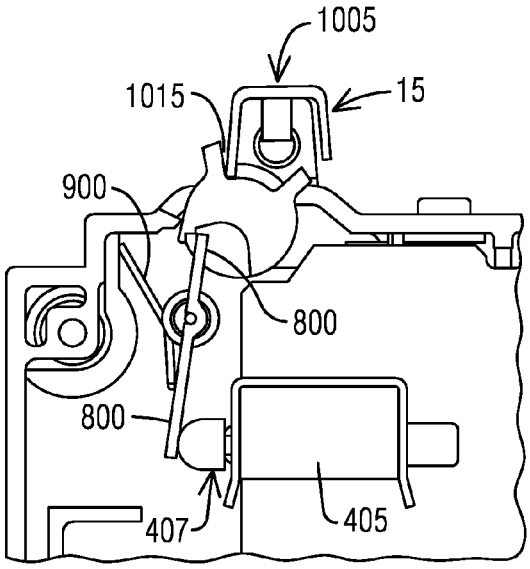
Figure 12:
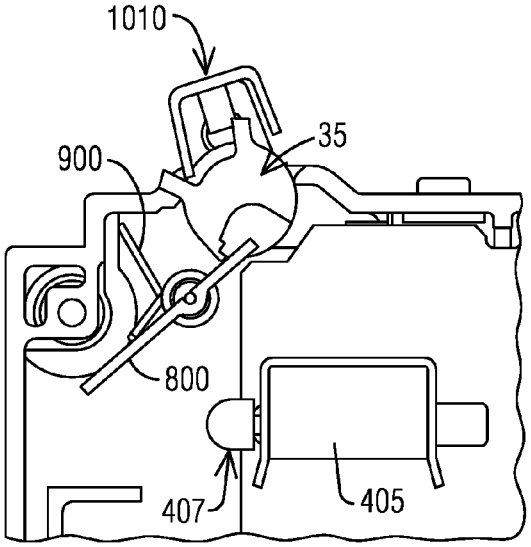

Now referring to FIGS. 10-12, they illustrate a side view of the breaker handle 15 of the two-pole circuit breaker 5 in a reset position 1000, a mid-position 1005, a fully ON position 1010, respectively in accordance with one illustrative embodiment of the present invention. In FIG. 10, the breaker handle 15 is shown in the reset position 1000 and the locking mechanism 10 latched.

Referencing to FIG. 11, the breaker handle 15 rotates to the mid-position 1005. The extended tab of the breaker handle tie bar 40 closes the gap with a locking shaft feature 1015. The locking handle shaft 35 is latched with the locking latch 800 features and unable to rotate past the mid-position 1005. The mid-position 1005 of the breaker handle 15 is a position before the breaker mechanism goes over center but before the breaker handle 15 is in the fully ON position 1010. The over center of a mechanism is when the spring forces are enough to rotate a contact arm as the breaker handle 15 is rotated towards the fully ON position 1010.

Figure 48:
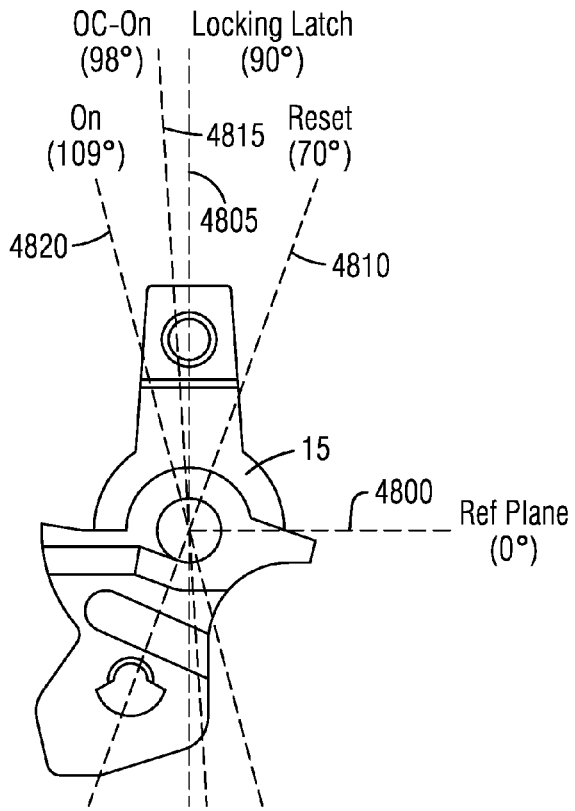
FIG. 48 illustrates positions of a breaker handle of a two-pole circuit breaker in accordance with one illustrative embodiment of the present invention.

In one embodiment, the locking handle shaft 35 is de-latched before the breaker handle 15 can rotate counterclockwise to a position the mechanism is at over center allowing the main contacts to close. (FIG. 48 shows the various positions of the breaker handle 15).

In the mid-position 1005, the PCB contacts 415 are now closed, as noted above, but the circuit breaker mechanism main contacts stay open. This triggers a self-test to begin. Once the self-test passes, the solenoid 405 is triggered and the plunger 407 is extended. The plunger 407 strikes a lower portion of the locking latch 800 surface. The locking latch 800 is rotated in a clockwise direction. This results in the locking latch 800 surface to disengage with the locking handle shaft 35 surface. In the event the de-latching force is too high, a lubricant or grease may be used to reduce the coefficient of friction between the two latching surfaces. Once the latching surfaces are free, the locking handle shaft 35 and the breaker handle 15 may continue to rotate counterclockwise toward the fully ON position as shown in FIG. 12.

The locking handle shaft 35 includes an opening for the top of the locking latch 800 to freely rotate clockwise. In the event that one or two of the electrical connecting wires 420*a*, 420*b* are broken or the self-test does not pass, the solenoid 405 will not be triggered to extend the plunger 407. The locking handle shaft 35 will remain latched with the locking latch 800 and the breaker handle 15 will not rotate to the fully ON position 1010. The breaker handle 15 will return to the reset position 1000 once released.

One of the locking latch journals 816*a*, 816*b* in the module two 25 are used to position the return torsion spring 900 using the inside spring diameter. When the breaker handle 15 is returned to the reset position 1000, the return torsion spring 900 leg provides about 0.2-0.4 pounds force on the locking latch 800 feature and rotates the locking latch 800 counterclockwise. This will return the locking latch 800 to its original state. The opposite leg of the return torsion spring 900 rests against the inside plastic wall of the module two 25.

As an alternative to the above arrangement, a torsion spring may be incorporated within the module two 25 and the locking handle shaft post pivots. One leg of the torsion spring may rest against the plastic wall of the module two 25. The opposite leg of the torsion spring may be nested into a hole or protrusion of the shaft posts 810*a*, 810*b* of the locking handle shaft 35.

Figure 13:
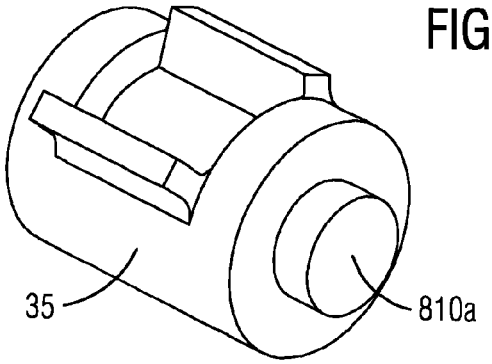
FIGS. 13-14 illustrate an isometric view of a locking handle shaft of a two-pole circuit breaker in accordance with one illustrative embodiment of the present invention.
Figure 14:
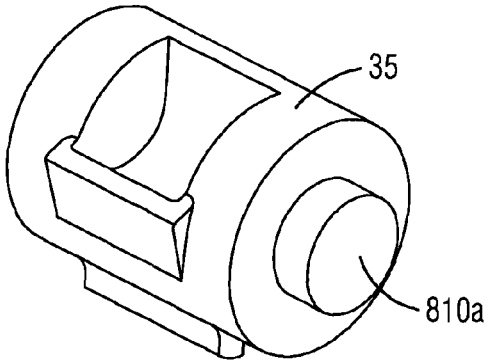
Figure 15:
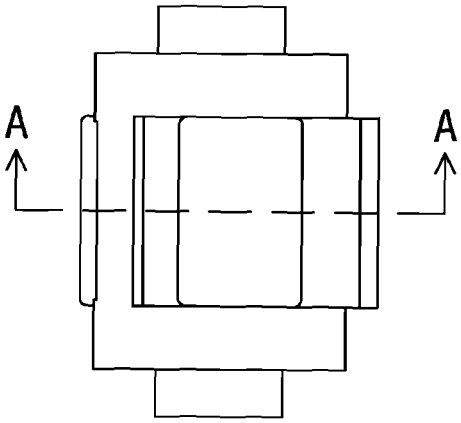
FIG. 15 illustrates a top view of a locking handle shaft of a two-pole circuit breaker in accordance with one illustrative embodiment of the present invention.
Figure 16:
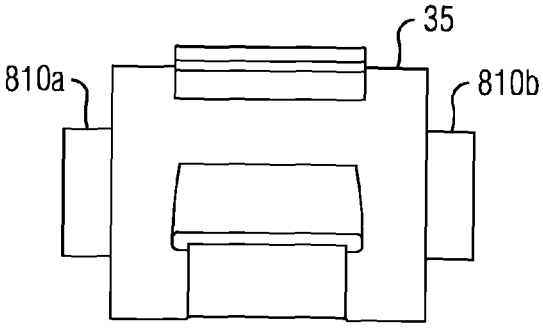
FIG. 16 illustrates a side view of a locking handle shaft of a two-pole circuit breaker in accordance with one illustrative embodiment of the present invention.

FIGS. 13-14 illustrate an isometric view of the locking handle shaft 35 of the two-pole circuit breaker 5 in accordance with one illustrative embodiment of the present invention. FIG. 15 illustrates a top view of the locking handle shaft 35 of the two-pole circuit breaker 5 in accordance with one illustrative embodiment of the present invention. FIG. 16 illustrates a side view of the locking handle shaft 35 of the two-pole circuit breaker 5 in accordance with one illustrative embodiment of the present invention.

FIG. 17 illustrates a cross-sectional view of the locking handle shaft 35 of the two-pole circuit breaker 5 shown in FIG. 15 at an A-A axis in accordance with one illustrative embodiment of the present invention. The breaker handle 15 is used to rotate the locking latch 800 from the fully ON position 1010 to the reset position 1000. As the breaker handle 15 is rotated from the fully ON position 1010, the breaker handle tie bar 40 feature, i.e., the extended tab separates from a locking handle shaft feature 1705. As can be seen from FIG. 12, as the breaker handle 15 rotates clockwise the breaker handle tie bar 40 feature will rotate the locking handle shaft 35 clockwise with a feature 1700. The locking handle shaft 35 includes an opening 1710 for the top of the locking latch 800 to freely rotate clockwise. The locking handle shaft 35 includes a recess 1715 that interfaces with an extended tab of the breaker handle tie bar 40 to latch the locking mechanism 10 shown in FIG. 1.

FIG. 18 illustrates another side view of the locking handle shaft 35 of the two-pole circuit breaker 5 in accordance with one illustrative embodiment of the present invention. FIG. 19 illustrates another top view of the locking handle shaft 35 of the two-pole circuit breaker 5 in accordance with one illustrative embodiment of the present invention.

FIG. 20 illustrates a cutout cross-sectional view of the locking handle shaft 35 of the two-pole circuit breaker 5 shown in FIG. 17 in accordance with one illustrative embodiment of the present invention. The locking handle shaft 35 includes a stop feature 2000 on the locking handle shaft 35 to prevent the locking latch 800 from over rotating counterclockwise and bypassing a latch surface or a locking shaft feature 2005.

FIGS. 21-22 illustrate an isometric view of the locking latch 800 of the two-pole circuit breaker 5 in accordance with one illustrative embodiment of the present invention. As shown in FIG. 4, the solenoid 405 with the plunger 407 is used to disengage the locking shaft feature 2005 and a locking latch feature 2100 of the locking latch 800. The locking latch 800 rotates clockwise and the locking latch feature 2100 disengages with the locking shaft feature 2005. Once de-latched, the locking handle shaft 35 is free to rotate counterclockwise allowing the breaker handle 15 to rotate to the fully ON position 1010 as shown in FIG. 12.

FIG. 23 illustrates a top view of the locking latch 800 of the two-pole circuit breaker 5 in accordance with one illustrative embodiment of the present invention. FIG. 24 illustrates a cross-sectional view of the locking latch 800 of the two-pole circuit breaker 5 shown in FIG. 23 at an A-A axis in accordance with one illustrative embodiment of the present invention. The locking latch 800 includes a channel 2105 to receive the latch pivot pin 805. The locking latch 800 further includes a first locking latch surface 2110. As described above, the self-test is active for a short duration and if passes, the solenoid 405 is triggered forcing the plunger 407 to strike the first locking latch surface 2110, shown in FIG. 11. The solenoid plunger 407 strikes a lower portion of the first locking latch surface 2110.

The locking latch 800 further includes a second locking latch surface 2115. When the breaker handle 15 is returned to the reset position 1000, the return torsion spring 900 leg provides about 0.2-0.4 pounds force on the second locking latch surface 2115 and rotates the locking latch 800 counterclockwise. This returns the locking latch 800 to its original state. The locking latch 800 further includes a third locking latch surface 2120 adjacent the locking latch feature 2100 of the locking latch 800.

FIG. 25 illustrates a side view of the locking latch 800 of the two-pole circuit breaker 5 in accordance with one illustrative embodiment of the present invention. In one embodiment, the locking latch 800 may be made of a metal such as stainless steel or CRS 1010.

Figure 26:
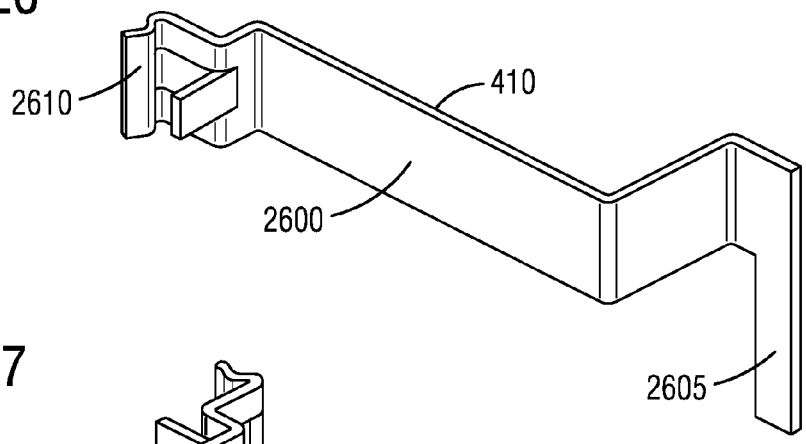
FIGS. 26-27 illustrate an isometric view of a PCB spring of a two-pole circuit breaker in accordance with one illustrative embodiment of the present invention.
Figure 27:
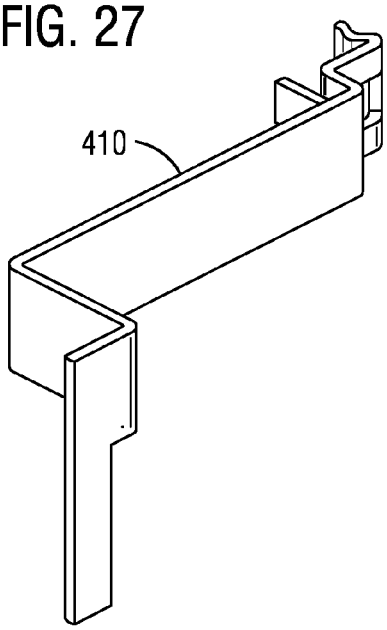

FIGS. 26-27 illustrate an isometric view of the PCB contact spring 410 of the two-pole circuit breaker 5 in accordance with one illustrative embodiment of the present invention. The PCB contact spring 410 is configured to be attached to the PCB 400 of FIG. 4 for mounting and providing an electrical connection. The PCB contact spring 410 includes a bottom side 2600 and a tip 2605. On the opposite end of the PCB contact spring 410, a contact is welded to the bottom side 2600. On the top side of the PCB contact spring 410, a handle switch feature wraps around the tip 2605 of the PCB contact spring 410. The PCB contact spring 410 further includes a PCB mounting feature 2610 on the opposite end to the tip 2605.

Figure 28:
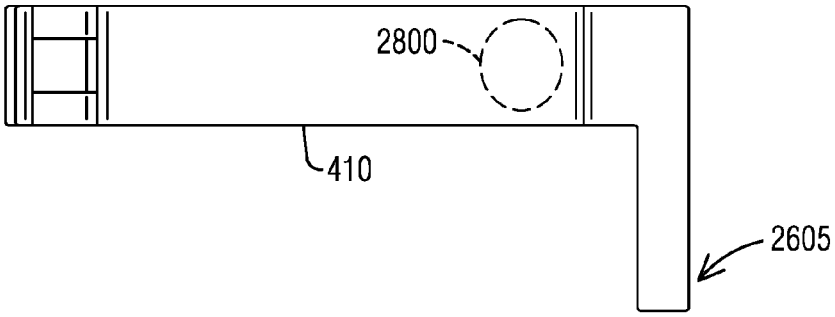
FIG. 28 illustrates a top view of a PCB spring of a two-pole circuit breaker in accordance with one illustrative embodiment of the present invention.
Figure 29:
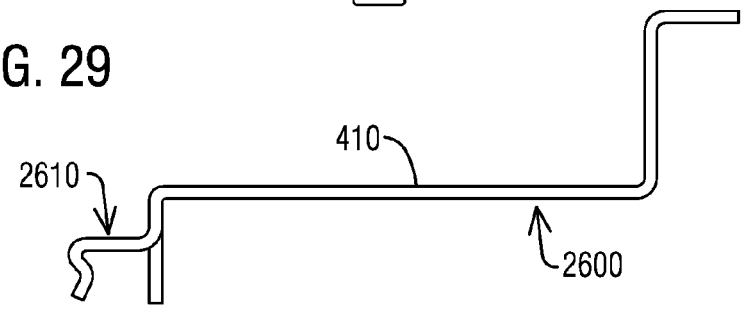
FIG. 29 illustrates a side view of a PCB spring of a two-pole circuit breaker in accordance with one illustrative embodiment of the present invention.

FIG. 28 illustrates a top view of the PCB contact spring 410 of the two-pole circuit breaker 5 in accordance with one illustrative embodiment of the present invention. FIG. 28 shows a contact location 2800 welded to back side of the PCB contact spring 410. FIG. 29 illustrates a side view of the PCB contact spring 410 of the two-pole circuit breaker 5 in accordance with one illustrative embodiment of the present invention.

FIGS. 30-31 illustrate an isometric view of the handle switch 300 of the two-pole circuit breaker 5 in accordance with one illustrative embodiment of the present invention. In FIG. 30, the handle switch 300 includes a wall 3000 around the lower portion of the handle switch 300 so to be retained in the module two 25.

FIG. 32 illustrates a top view of the handle switch 300 of the two-pole circuit breaker 5 in accordance with one illustrative embodiment of the present invention. FIG. 33 illustrates a cross-sectional view of the handle switch 300 of the two-pole circuit breaker 5 shown in FIG. 32 at an A-A axis in accordance with one illustrative embodiment of the present invention.

In accordance with one embodiment, the handle switch 300 includes a first surface 3200, a second surface 3205 and a handle switch feature 3210. As the breaker handle 15 is rotated counterclockwise from the reset position 1000, the breakers handle feature 500 contacts the first surface 3200 of the handle switch 300. When breaker handle 15 is allowed to fully rotate to the fully ON position 1010, the breaker handle feature 500 disengages with the second surface 3205 of the handle switch 300. On the top side of the PCB contact spring 410, the handle switch feature 3210 wraps around the tip 2605 of the PCB contact spring 410.

FIG. 34 illustrates a side view of the handle switch 300 of the two-pole circuit breaker 5 in accordance with one illustrative embodiment of the present invention. The handle switch 300 includes a main body 3400 from which the wall 3000 extends or projects away, forming a ring-like structure near a base 3405 of the handle switch 300.

Figure 35:
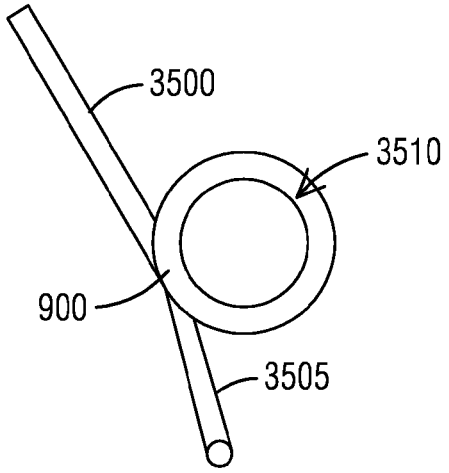
FIG. 35 illustrates a side view of a torsion return spring of a two-pole circuit breaker in accordance with one illustrative embodiment of the present invention.

FIG. 35 illustrates a side view of the torsion return spring 900 of the two-pole circuit breaker 5 in accordance with one illustrative embodiment of the present invention. The torsion return spring 900 includes a first leg 3500 and a second leg 3505. The torsion return spring 900 may have an inside spring diameter 3510 of a desired dimension based on certain factors such as a size of the two-pole circuit breaker 5. The first leg 3500 of the return torsion spring 900 rests against the inside plastic wall of the module two 25. A post in the module two 25 is used to position the return torsion spring 900 using the inside spring diameter 3510. When the breaker handle 15 is returned to the reset position 1000, the second leg 3505 of the return torsion spring 900 provides about 0.2-0.4 pounds of force on the second locking latch surface 2115 and rotates the locking latch 800 counterclockwise.

Figure 36:
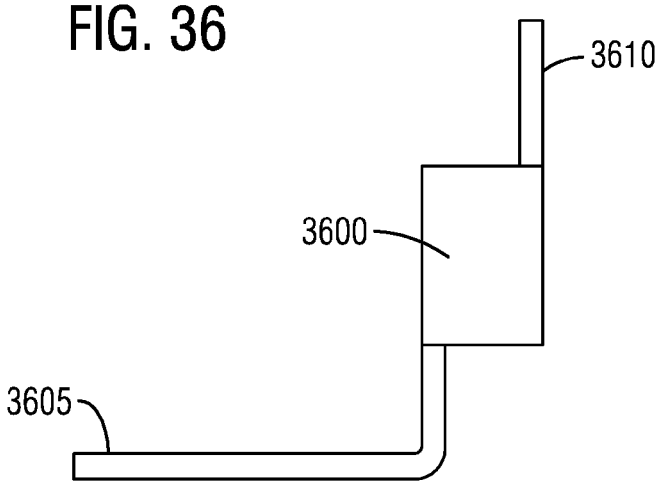
FIG. 36 illustrates a side view of another torsion return spring of a two-pole circuit breaker in accordance with one illustrative embodiment of the present invention.

FIG. 36 illustrates a side view of a first torsion return spring 3600 of the two-pole circuit breaker 5 in accordance with one illustrative embodiment of the present invention. The first torsion return spring 3600 includes a first leg 3610 and a second leg 3605. When the breaker handle 15 is returned to the reset position 1000, the second leg 3605 of the first return torsion spring 3600 provides about 0.2-0.4 pounds of force on the second locking latch surface 2115 and rotates the locking latch 800 counterclockwise.

Figure 37:
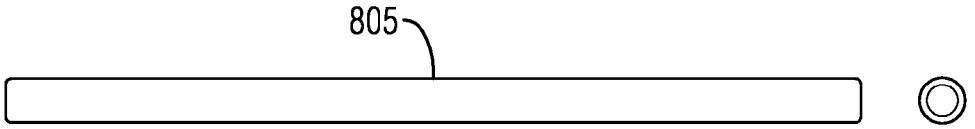
FIG. 37 illustrates side views of a latch pivot pin of a two-pole circuit breaker in accordance with one illustrative embodiment of the present invention.

FIG. 37 illustrates side views of the latch pivot pin 805 of the two-pole circuit breaker 5 in accordance with one illustrative embodiment of the present invention. The latch pivot pin 805 holds the locking latch 800 in position. The latch pivot pin 805 may be made of a metal such as stainless steel or CRS 1010.

Figure 38:
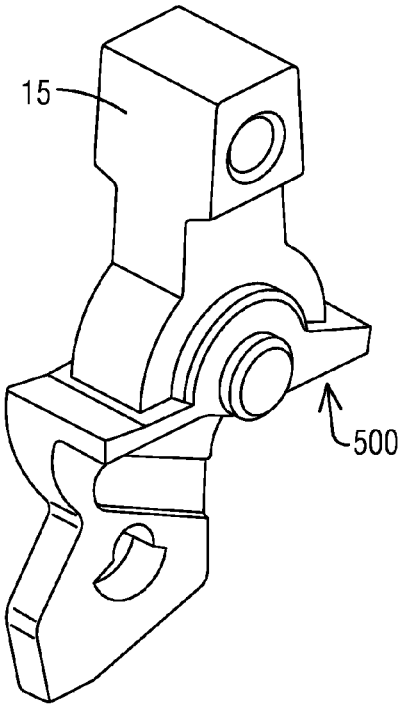
FIGS. 38-39 illustrate an isometric view of a breaker handle of a two-pole circuit breaker in accordance with one illustrative embodiment of the present invention.
Figure 39:
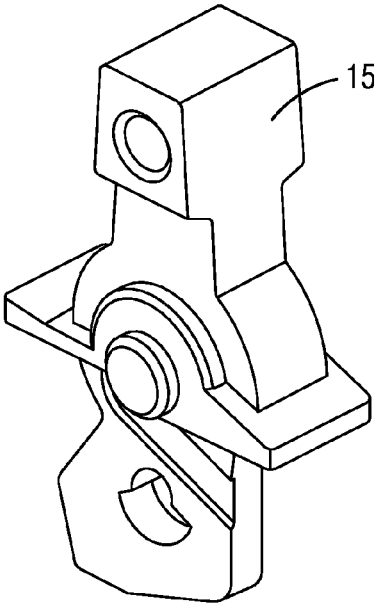

FIGS. 38-39 illustrate an isometric view of the breaker handle 15 of the two-pole circuit breaker 5 in accordance with one illustrative embodiment of the present invention. The breaker handle 15 includes the breaker handle feature 500 to contact a surface of the handle switch 300 to make an electrical contact between the PCB contacts 415. Once the electrical contact is made, the self-test circuit 430 is closed and a self-test is conducted to verify whether arc and/or ground fault detection circuitry in the PCB 400 is functioning appropriately. If the arc and/or ground fault detection circuitry is determined to be functioning properly, the breaker handle 15 is rotated from the mid-position 1005 to the fully ON position 1010.

Figure 40:
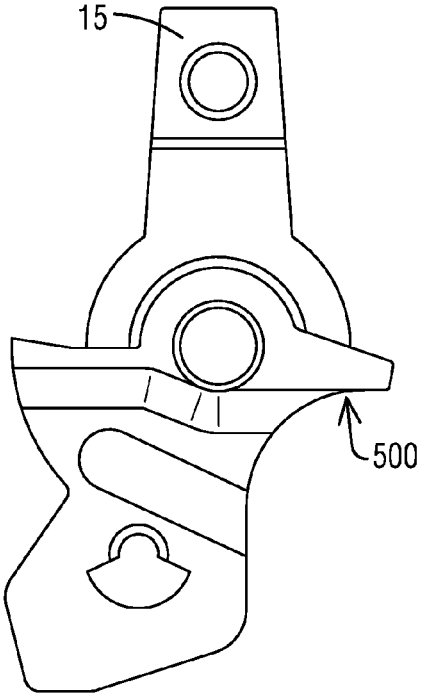
FIG. 40 illustrates a top view of a breaker handle of a two-pole circuit breaker in accordance with one illustrative embodiment of the present invention.
Figure 41:
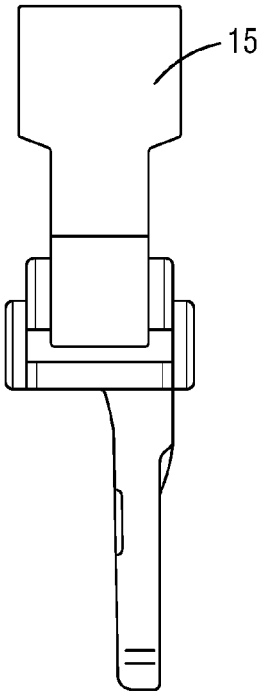
FIG. 41 illustrates a side view of a breaker handle of a two-pole circuit breaker in accordance with one illustrative embodiment of the present invention.

FIG. 40 illustrates a top view of the breaker handle 15 of the two-pole circuit breaker 5 in accordance with one illustrative embodiment of the present invention. FIG. 41 illustrates a side view of the breaker handle 15 of the two-pole circuit breaker 5 in accordance with one illustrative embodiment of the present invention.

Figure 42:
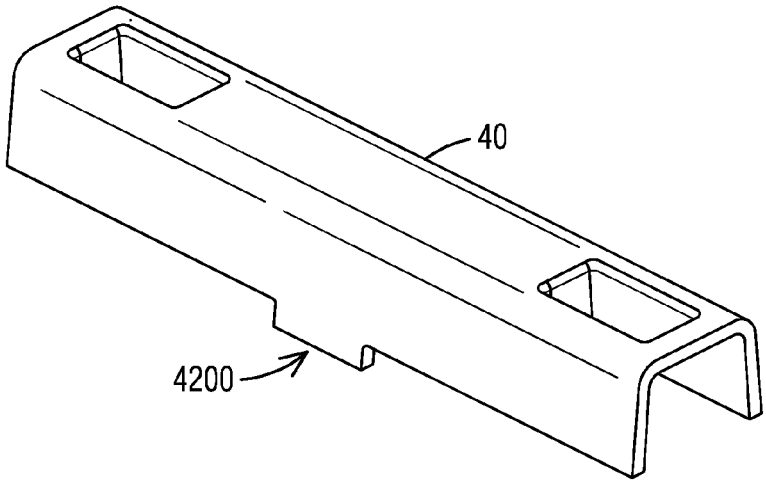
FIG. 42 illustrates an isometric view of a handle tie bar of a two-pole circuit breaker in accordance with one illustrative embodiment of the present invention.

FIG. 42 illustrates an isometric view of the breaker handle tie bar 40 of the two-pole circuit breaker 5 in accordance with one illustrative embodiment of the present invention. The breaker handle tie bar 40 overlaps each breaker handle portion in the module one 20 and the module three 30 and includes an extended tab 4200 to interface with the recess 1715 in the locking handle shaft 35. The breaker handle 15 is used to rotate the locking latch 800 from the fully ON position 1010 to the reset position 1000. As the breaker handle 15 is rotated from the fully ON position 1010, the extended tab 4200 separates from the locking shaft feature 1015. As the breaker handle 15 rotates clockwise the extended tab 4200 will rotate the locking handle shaft 35 clockwise.

Figure 43:
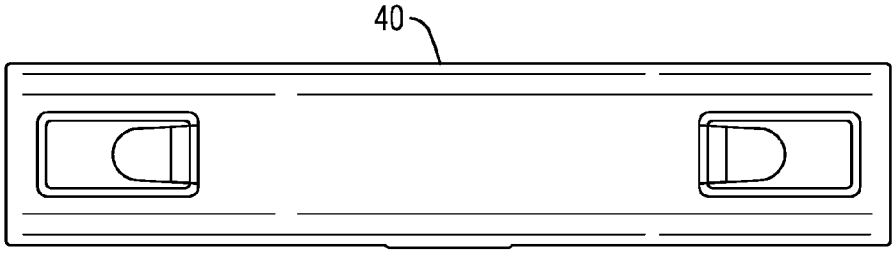
FIG. 43 illustrates a top view of a handle tie bar of a two-pole circuit breaker in accordance with one illustrative embodiment of the present invention.
Figure 44:
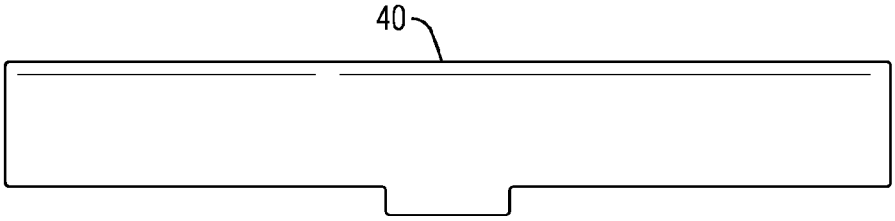
FIG. 44 illustrates a side view of a handle tie bar of a two-pole circuit breaker in accordance with one illustrative embodiment of the present invention.
Figure 45:
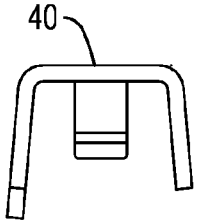
FIG. 45 illustrates a side view of a handle tie bar of a two-pole circuit breaker in accordance with one illustrative embodiment of the present invention.

FIG. 43 illustrates a top view of the breaker handle tie bar 40 of the two-pole circuit breaker 5 in accordance with one illustrative embodiment of the present invention. FIG. 44 illustrates a side view of the breaker handle tie bar 40 of the two-pole circuit breaker 5 in accordance with one illustrative embodiment of the present invention. FIG. 45 illustrates a side view of the breaker handle tie bar 40 of the two-pole circuit breaker 5 in accordance with one illustrative embodiment of the present invention.

Figure 46:
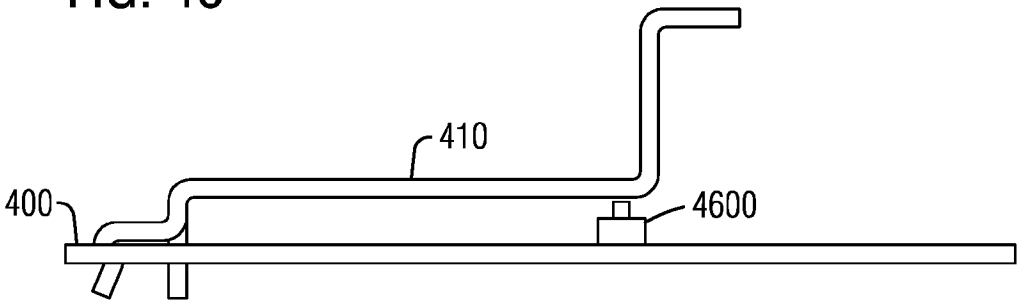
FIG. 46 illustrates a side view of an alternate to two contacts of a PCB spring in FIG. 4 of a two-pole circuit breaker in accordance with one illustrative embodiment of the present invention.

FIG. 46 illustrates a side view of an alternate to two contacts of the PCB contact spring 410 in FIG. 4 of the two-pole circuit breaker 5 in accordance with one illustrative embodiment of the present invention. As an alternative to the PCB arrangement shown in FIG. 4, the contacts 415 may be replaced with a micro switch or a dome type switch 4600 mounted to the PCB 400. In this case, the PCB contact spring 410 may be made of a stainless steel alloy and a PCB spring contact would not be needed on the bottom side. In this alternative arrangement, the bottom surface of the PCB contact spring 410 would deflect downward to activate the micro switch or the dome type switch 4600 mounted directly to the PCB 400.

Figure 47:
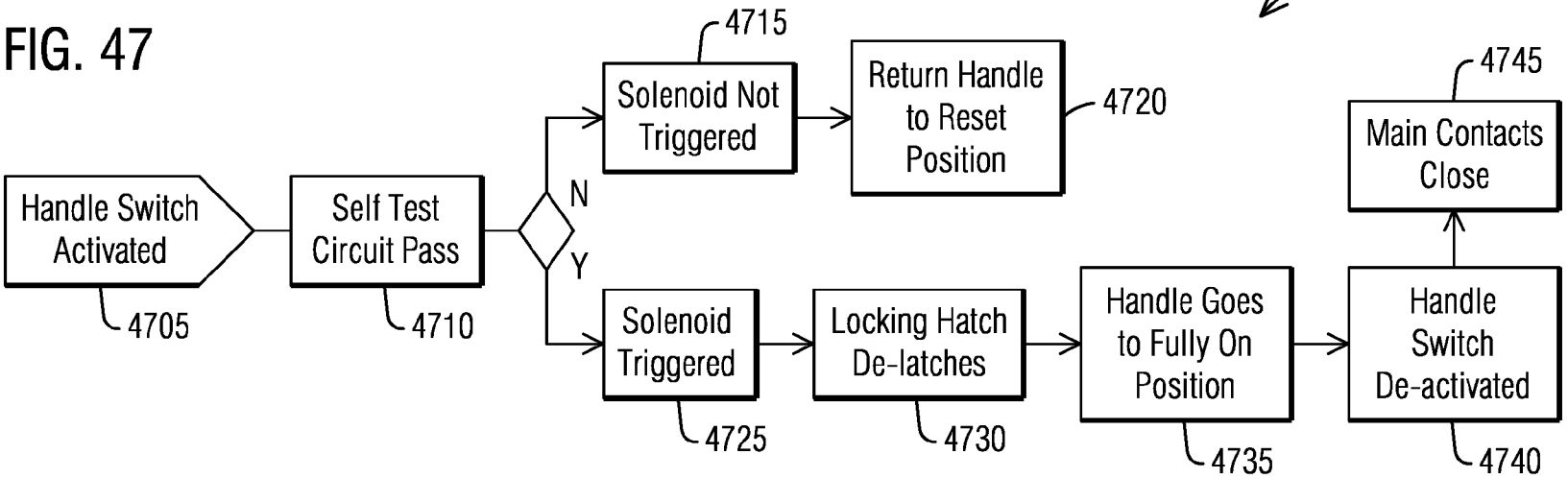
FIG. 47 illustrates a decision tree of operation of a two-pole circuit breaker in accordance with one illustrative embodiment of the present invention.

FIG. 47 illustrates a decision tree 4700 of operation of the two-pole circuit breaker 5 in accordance with one illustrative embodiment of the present invention. The decision tree 4700 shows a flow diagram of the various events to de-latch the locking mechanism 10. It shows how the locking mechanism 10 will de-latch after the solenoid 405 is triggered.

In block 4705 of the decision tree 4700, the handle switch 300 is activated. At block 4710, the self-test circuit 430 initiates a self-test to verify whether arc and/or ground fault detection circuitry in the PCB 400 is functioning properly. If the self-test fails, in block 4715, the solenoid 405 is not triggered. At block 4720, the breaker handle 15 is returned to the reset position 1000. If the self-test passes, at block 4725, the solenoid 405 is triggered. In block 4730, the locking latch 800 detaches from the locking handle shaft 35. At block 4735, the breaker handle goes to the fully ON position 1010. At block 4740, the handle switch 300 is de-activated. In block 4745, the main contacts of the two-pole circuit breaker 5 close.

FIG. 48 illustrates various handle positions of the breaker handle 15 of the two-pole circuit breaker 5 relative to a reference plane (0°) 4800 in accordance with one illustrative embodiment of the present invention. In the FIG. 48, the breaker handle 15 is shown in the mid-position 1005 labeled as a locking latch position (90°) 4805. The breaker handle 15 can take the reset position 1000 labeled as "Reset (70°)" 4810. The breaker handle 15 can take an Over Center to ON (OC-ON) (98°) 4815 position. The Over Center to ON (OC-ON) (98°) 4815 position is when the spring forces are enough to rotate a contact arm as the breaker handle 15 is rotated towards the fully ON position 1010. The breaker handle 15 can take the fully ON position 1010 labeled as "On (109°)" 4820.

Figure 49:
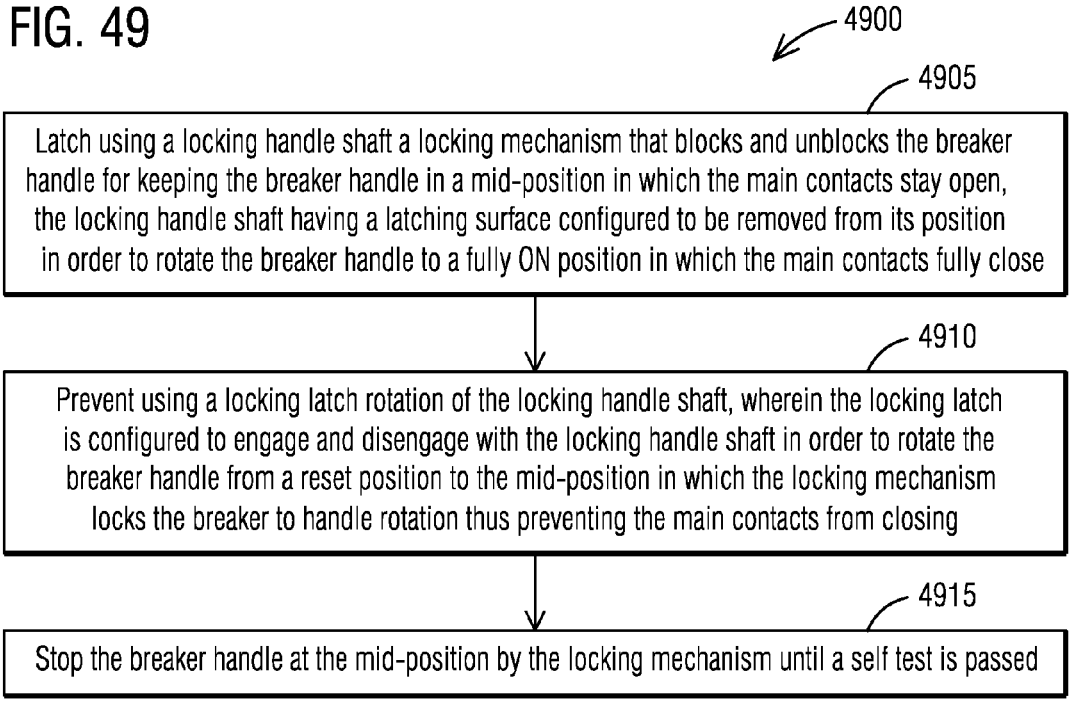
FIG. 49 illustrates a flow chart of a method of blocking and unblocking a breaker handle of a circuit breaker in accordance with an exemplary embodiment of the present invention.

FIG. 49 illustrates a flow chart of a method 4900 of blocking and unblocking the breaker handle 15 of the two-pole circuit breaker 5 having main contacts in accordance with an exemplary embodiment of the present invention. Reference is made to the elements and features described in FIGS. 1-48. It should be appreciated that some steps are not required to be performed in any particular order, and that some steps are optional.

The method 4900 of blocking and unblocking the breaker handle 15, in step 4905, includes latching using the locking handle shaft 35 the locking mechanism 10 that blocks and unblocks the breaker handle 15 for keeping the breaker handle 15 in the mid-position 1005 in which the main contacts of the two-pole circuit breaker 5 stay open. The locking handle shaft 35 has a latching surface configured to be removed from its position in order to rotate the breaker handle 15 to the fully ON position 1010 in which the main contacts fully close. The method 4900 of blocking and unblocking the breaker handle 15, in step 4910, further includes preventing using the locking latch 800 rotation of the locking handle shaft 35. The locking latch 800 is configured to engage and disengage with the locking handle shaft 35 in order to rotate the breaker handle 15 from the reset position 1000 to the mid-position 1005 in which the locking mechanism 10 locks the breaker handle 15 rotation thus preventing the main contacts from closing. The method 4900 of blocking and unblocking the breaker handle 15, in step 4915, further includes stopping the breaker handle 15 at the mid-position 1005 until a self-test is passed.

The method 4900 of blocking and unblocking the breaker handle 15 further includes disengaging the locking handle shaft 35 and the locking latch 800 to de-latch the locking mechanism 10 by forcing the rotation of the locking latch 800 to rotate clockwise once triggered for rotating the breaker handle 15 from the mid-position 1005 to the Over Center to ON (OC-ON) position 4815. The locking handle shaft 35 is configured to de-latch before the breaker handle 15 rotates counterclockwise to the fully ON position 1010 from the Over Center to ON (OC-ON) position 4815 of the breaker handle 15 allowing the main contacts to fully close. The method 4900 of blocking and unblocking the breaker handle 15 further includes activating the handle switch 300 during rotation of the breaker handle 15 and de-activate the handle switch 300 when the breaker handle 15 is rotated to the fully ON position 1010. The locking latch 800 is configured to rotate the breaker handle 15 to the Over Center to ON (OC-ON) position 4815 in which the locking mechanism 10 unlocks the breaker handle 15 rotation thus moving the main contacts to close and then to rotate the breaker handle 15 to the fully ON position 1010.

An example of the two-pole circuit breaker 5 is a two-pole residential electronic circuit breaker that stops the rotation of the breaker handle 15 under certain conditions. The locking mechanism 10 provides a means to prevent the breaker handle 15 from rotating to the fully ON position 1010 until certain conditions are met. This is performed by several internal components of the locking mechanism 10 that interface with the breaker handle 15. Although a two-pole circuit breaker is pictorially shown, slight modifications could be made to incorporate the locking mechanism 10 to a single-pole residential electronic circuit breaker.

Embodiments of the present invention apply to two-pole circuit breakers (Mechanical pole, GFCI, or CAFCI) in that it adds a valuable safety feature. This safety feature could be included in any of GFCI or AFCI or CAFCI multi-pole circuit breakers.

While embodiments of the present invention have been disclosed in exemplary forms, it will be apparent to those skilled in the art that many modifications, additions, and deletions can be made therein without departing from the spirit and scope of the invention and its equivalents, as set forth in the following claims.

Embodiments and the various features and advantageous details thereof are explained more fully with reference to the non-limiting embodiments that are illustrated in the accompanying drawings and detailed in the following description. Descriptions of well-known starting materials, processing techniques, components and equipment are omitted so as not to unnecessarily obscure embodiments in detail. It should be understood, however, that the detailed description and the specific examples, while indicating preferred embodiments, are given by way of illustration only and not by way of limitation. Various substitutions, modifications, additions and/or rearrangements within the spirit and/or scope of the underlying inventive concept will become apparent to those skilled in the art from this disclosure.

As used herein, the terms "comprises," "comprising," "includes," "including," "has," "having" or any other variation thereof, are intended to cover a non-exclusive inclusion. For example, a process, article, or apparatus that comprises a list of elements is not necessarily limited to only those elements but may include other elements not expressly listed or inherent to such process, article, or apparatus.

Additionally, any examples or illustrations given herein are not to be regarded in any way as restrictions on, limits to, or express definitions of, any term or terms with which they are utilized. Instead, these examples or illustrations are to be regarded as being described with respect to one particular embodiment and as illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms.

In the foregoing specification, the invention has been described with reference to specific embodiments. However, one of ordinary skill in the art appreciates that various modifications and changes can be made without departing from the scope of the invention. Accordingly, the specification and figures are to be regarded in an illustrative rather than a restrictive sense, and all such modifications are intended to be included within the scope of invention.

Although the invention has been described with respect to specific embodiments thereof, these embodiments are merely illustrative, and not restrictive of the invention. The description herein of illustrated embodiments of the invention is not intended to be exhaustive or to limit the invention to the precise forms disclosed herein (and in particular, the inclusion of any particular embodiment, feature or function is not intended to limit the scope of the invention to such embodiment, feature or function). Rather, the description is intended to describe illustrative embodiments, features and functions in order to provide a person of ordinary skill in the art context to understand the invention without limiting the invention to any particularly described embodiment, feature or function. While specific embodiments of, and examples for, the invention are described herein for illustrative purposes only, various equivalent modifications are possible within the spirit and scope of the invention, as those skilled in the relevant art will recognize and appreciate. As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

Respective appearances of the phrases "in one embodiment," "in an embodiment," or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

Although the steps, operations, or computations may be presented in a specific order, this order may be changed in different embodiments. In some embodiments, to the extent multiple steps are shown as sequential in this specification, some combination of such steps in alternative embodiments may be performed at the same time.

Embodiments described herein can be implemented in the form of control logic in software or hardware or a combination of both. The control logic may be stored in an information storage medium, such as a computer-readable medium, as a plurality of instructions adapted to direct an information processing device to perform a set of steps disclosed in the various embodiments. Based on the disclosure and teachings provided herein, a person of ordinary skill in the art will appreciate other ways and/or methods to implement the invention.

It will also be appreciated that one or more of the elements depicted in the drawings/figures can also be implemented in a more separated or integrated manner, or even removed or rendered as inoperable in certain cases, as is useful in accordance with a particular application.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component.

What is claimed is:

1. An apparatus to block and unblock a breaker handle of a circuit breaker having main contacts, the apparatus comprising:

a locking mechanism including:

a locking handle shaft configured to latch the locking mechanism for keeping the breaker handle in a mid-position in which the main contacts stay open, the locking handle shaft having a latching surface configured to be removed from its position in order to rotate the breaker handle to a fully ON position in which the main contacts fully close; and a locking latch is configured to prevent rotation of the locking handle shaft, wherein the locking latch is configured to engage and disengage with the locking handle shaft in order to rotate the breaker handle from a reset position to the mid-position in which the locking mechanism locks the breaker handle rotation thus preventing the main contacts from closing, wherein the breaker handle is stopped at the mid-position by the locking mechanism until a self-test is passed.

2. The apparatus of claim 1, wherein the locking latch is configured to rotate the breaker handle to an Over Center to ON (OC-ON) position in which the locking mechanism unlocks the breaker handle rotation thus moving the main contacts to close and then to rotate the breaker handle to the fully ON position.

3. The apparatus of claim 2, wherein the locking mechanism further includes:

a solenoid with a plunger configured to disengage the locking handle shaft and the locking latch to de-latch the locking mechanism by forcing the rotation of the locking latch to rotate clockwise once triggered for rotating the breaker handle from the mid-position to the Over Center to ON (OC-ON) position.

4. The apparatus of claim 3, wherein the locking handle shaft is configured to de-latch before the breaker handle rotates counterclockwise to the fully ON position from the Over Center to ON (OC-ON) position of the breaker handle allowing the main contacts to fully close.

5. The apparatus of claim 3, wherein the locking mechanism further includes:

a handle switch and an actuating lever to activate the handle switch during rotation of the breaker handle and de-activate the handle switch when the breaker handle is rotated to the fully ON position.

6. The apparatus of claim 5, wherein the breaker handle having an extended tab to contact a surface of the handle switch to close a test circuit for performing the self-test to verify whether an Arc and/or Ground fault detection circuitry of the circuit breaker is working properly.

7. The apparatus of claim 1, wherein the locking handle shaft having a stop and the locking latch defines a latching lever such that when the breaker handle is moved to the reset position the latching lever is rotated counterclockwise and the latching lever stops against the stop of the locking handle shaft.

8. The apparatus of claim 1, wherein the locking latch is configured to rotate about a pivot.

9. The apparatus of claim 1, wherein the locking handle shaft having a recess that interfaces with an extended tab of a breaker handle tie bar to latch the locking mechanism.

10. The apparatus of claim 1, wherein the locking mechanism further includes:

an integrated return torsion spring for the locking latch.

11. The apparatus of claim 1, wherein the locking mechanism further includes:

a driving-counterclockwise feature to rotate the locking handle shaft counterclockwise; and a return-clockwise feature to rotate the locking handle shaft clockwise.

12. A circuit breaker having main contacts, the circuit breaker comprising:

a breaker handle; and first, second, and third modules, wherein the second module is disposed in between the first and third modules, wherein the second module including:

a locking mechanism to block and unblock the breaker handle of the circuit breaker, the locking mechanism including:

a locking handle shaft configured to latch the locking mechanism for keeping the breaker handle in a mid-position in which the main contacts stay open, the locking handle shaft having a latching surface configured to be removed from its position in order to rotate the breaker handle to a fully ON position in which the main contacts fully close, and a locking latch configured to prevent rotation of the locking handle shaft, wherein the locking latch is configured to engage and disengage with the locking handle shaft in order to rotate the breaker handle from a reset position to the mid-position in which the locking mechanism locks the breaker handle rotation thus preventing the main contacts from closing, wherein the breaker handle is stopped at the mid-position by the locking mechanism until a self-test is passed.

13. The circuit breaker of claim 12, wherein the locking latch to rotate the breaker handle to an Over Center to ON (OC-ON) position in which the locking mechanism unlocks the breaker handle rotation thus moving the main contacts to close and then to rotate the breaker handle to the fully ON position.

14. The circuit breaker of claim 13, wherein the locking mechanism further includes:

a solenoid with a plunger configured to disengage the locking handle shaft and the locking latch to de-latch the locking mechanism by forcing the rotation of the locking latch to rotate clockwise once triggered for rotating the breaker handle from the mid-position to the Over Center to ON (OC-ON) position.

15. The circuit breaker of claim 14, wherein the locking handle shaft is configured to de-latch before the breaker handle rotates counterclockwise to the fully ON position from the Over Center to ON (OC-ON) position of the breaker handle allowing the main contacts to fully close.

16. The circuit breaker of claim 14, wherein the locking mechanism further includes:

a handle switch and an actuating lever to activate the handle switch during rotation of the breaker handle and de-activate the handle switch when the breaker handle is rotated to the fully ON position.

17. The circuit breaker of claim 16, wherein the breaker handle having an extended tab to contact a surface of the handle switch to close a test circuit for performing the self-test to verify whether an Arc and/or Ground fault detection circuitry of the circuit breaker is working properly.

18. The circuit breaker of claim 12, wherein the locking handle shaft having a stop and the locking latch defines a latching lever such that when the breaker handle is moved to the reset position the latching lever is rotated counterclockwise and the latching lever stops against the stop of the locking handle shaft.

19. A method of blocking and unblocking a breaker handle of a circuit breaker having main contacts, the method comprising:

latching using a locking handle shaft a locking mechanism that blocks and unblocks the breaker handle for keeping the breaker handle in a mid-position in which the main contacts stay open, the locking handle shaft having a latching surface configured to be removed from its position in order to rotate the breaker handle to a fully ON position in which the main contacts fully close;

preventing using a locking latch rotation of the locking handle shaft, wherein the locking latch is configured to engage and disengage with the locking handle shaft in order to rotate the breaker handle from a reset position to the mid-position in which the locking mechanism locks the breaker handle rotation thus preventing the main contacts from closing; and stopping the breaker handle at the mid-position by the locking mechanism until a self-test is passed.

20. The method of claim 19, further including:

disengaging the locking handle shaft and the locking latch to de-latch the locking mechanism by forcing the rotation of the locking latch to rotate clockwise once triggered for rotating the breaker handle from the mid-position to an Over Center to ON (OC-ON) position, wherein the locking handle shaft is configured to de-latch before the breaker handle rotates counterclockwise to the fully ON position from the Over Center to ON (OC-ON) position of the breaker handle allowing the main contacts to fully close; and activating a handle switch during rotation of the breaker handle and de-activate the handle switch when the breaker handle is rotated to the fully ON position, wherein the locking latch to rotate the breaker handle to the Over Center to ON (OC-ON) position in which the locking mechanism unlocks the breaker handle rotation thus moving the main contacts to close and then to rotate the breaker handle to the fully ON position.

* * * * *